US005235713A

United States Patent [19]

Guthrie et al.

[11] Patent Number: 5,235,713

[45] Date of Patent: Aug. 17, 1993

[54] FLUID FILLED FLOTATION MATTRESS

[75] Inventors: Brian Guthrie, Pasadena; Keith Gilroy, Upland; Henry Canino, Ontario, all of Calif.

[73] Assignee: Bio Clinic Corporation, Ontario, Calif.

[21] Appl. No.: 788,303

[22] Filed: Nov. 5, 1991

[51] Int. Cl.[5] ..... A61G 7/057; A47C 27/10

[52] U.S. Cl. ..... 5/453; 5/411; 5/914

[58] Field of Search ..... 5/453, 455, 914, 456, 5/411; 137/561 A

[56] References Cited

U.S. PATENT DOCUMENTS

| | | | |
|---|---|---|---|
| 805,330 | 11/1905 | Tompkins | 5/411 |
| 2,241,793 | 5/1941 | Steven | 285/209 |
| 2,245,909 | 6/1941 | Enfiajian . | |
| 3,428,973 | 2/1969 | Hargest et al. . | |
| 3,650,551 | 3/1972 | Akers | 285/158 |
| 3,822,425 | 7/1974 | Scales . | |
| 3,866,606 | 2/1975 | Hargest | 128/71 |
| 3,909,858 | 10/1975 | Ducker . | |
| 3,913,156 | 10/1975 | Howorth . | |
| 4,017,118 | 4/1977 | Cawley | 297/284 |
| 4,099,276 | 7/1978 | Hunt et al. . | |
| 4,149,285 | 4/1979 | Stanton . | |
| 4,225,989 | 10/1980 | Corbett, et al. | 5/453 |
| 4,279,044 | 7/1981 | Douglas | 5/453 |

(List continued on next page.)

FOREIGN PATENT DOCUMENTS

| | | | |
|---|---|---|---|
| 0034954 | 9/1981 | European Pat. Off. . | |
| 0122666 | 10/1984 | European Pat. Off. . | |
| 8809651 | 12/1988 | PCT Int'l Appl. . | |
| 1273342 | 5/1972 | United Kingdom | 5/368 |
| 1341325 | 12/1973 | United Kingdom . | |
| 1474018 | 5/1977 | United Kingdom . | |
| 1545806 | 6/1979 | United Kingdom | 5/455 |
| 1595417 | 8/1981 | United Kingdom . | |
| 1601808 | 11/1981 | United Kingdom . | |
| 2077859B | 9/1984 | United Kingdom . | |
| 2070426 | 11/1984 | United Kingdom . | |
| 2141333 | 12/1984 | United Kingdom . | |
| 2221387 | 2/1990 | United Kingdom | 5/453 |

OTHER PUBLICATIONS

National Research Council Canada, Division of Mechanical Engineering, *Medical Instrumentation*, vol. 3, No. 1 Jun. 1976 "The NRC Hospital Air Program" U. W. Schaub, Engine Laboratory.

*Primary Examiner*—Alexander Grosz
*Attorney, Agent, or Firm*—Christie, Parker & Hale

[57] ABSTRACT

An air-filled mattress with virtually no air loss has a plurality of air-filled bags grouped into zones of uniform air pressure. A controller monitors the air pressure in each zone and activates a blower to adjust the pressure in any zone in which the measured pressure differs from the desired pressure by more than a threshold amount. The blower is otherwise deactivated. The bags are deflated by reversing the direction of flow from the bags to the blower. The bags are fastened to a mattress base using an attachment fitting that receives an elongated bead on the bag's bottom edge into a chamber along the mattress base fitting. The mattress base can be attached to any of a variety of different conventional bed frames. Tabs fastened to the mattress base having a hinge and a hand malleable aluminum plate can be bent to grasp a variety of different bed frames. A unique air manifold between the blower and the bags, a unique hose coupling between the blower and the manifold and a unique air coupling between the manifold and the bags are also described. The controller is incorporated into an independent housing with an adjustable handle, wheels and a movable keyboard and is operated according to a four-mode control program.

27 Claims, 19 Drawing Sheets

U.S. PATENT DOCUMENTS

| | | | |
|---|---|---|---|
| 4,483,029 | 11/1984 | Paul | 5/453 |
| 4,488,322 | 12/1984 | Hunt et al. | 5/453 |
| 4,525,885 | 7/1985 | Hunt et al. | 5/453 |
| 4,525,886 | 7/1985 | Savenije | 5/464 |
| 4,542,547 | 9/1985 | Sato | 5/453 |
| 4,564,965 | 1/1986 | Goodwin | 5/483 |
| 4,630,847 | 12/1986 | Blenkush | 285/29 |
| 4,631,767 | 12/1986 | Carr et al. | 5/449 |
| 4,637,083 | 1/1987 | Goodwin | 5/453 |
| 4,638,519 | 1/1987 | Hess | 5/453 |
| 4,679,264 | 7/1987 | Mollura | 5/453 |
| 4,682,378 | 7/1987 | Savenije | 5/239 |
| 4,686,722 | 8/1987 | Swart | 5/453 |
| 4,694,520 | 9/1987 | Paul et al. | 5/453 |
| 4,711,275 | 12/1987 | Ford et al. | 141/95 |
| 4,745,647 | 5/1988 | Goodwin | 5/453 |
| 4,794,937 | 1/1989 | Hofmann | 137/614 |
| 4,803,744 | 2/1989 | Peck et al. | 5/453 |
| 4,833,614 | 5/1989 | Saitoh et al. | 364/424 |
| 4,834,825 | 5/1989 | Adams et al. | 156/294 |
| 4,858,966 | 8/1989 | Ciriscioli et al. | 285/200 |
| 4,864,671 | 9/1989 | Evans | 5/453 |
| 4,873,737 | 10/1989 | Savenije | 5/453 |
| 4,935,968 | 6/1990 | Hunt et al. | 5/453 |
| 4,938,528 | 7/1990 | Scott | 297/284 |
| 4,941,220 | 7/1990 | DiMatteo et al. | 5/81.1 |
| 4,942,635 | 7/1990 | Hargest et al. | 5/453 |
| 4,944,060 | 7/1990 | Peery et al. | 5/453 |
| 4,949,412 | 8/1990 | Goode | 5/453 |
| 4,949,413 | 8/1990 | Goodwin | 5/453 |
| 4,949,414 | 8/1990 | Thomas et al. | 5/453 |
| 4,962,552 | 10/1990 | Hasty | 5/453 |
| 4,982,466 | 1/1991 | Higgins et al. | 5/453 |
| 4,989,283 | 2/1991 | Krouskop | 5/453 |
| 4,995,124 | 2/1991 | Wringe, Jr. et al. | 5/453 |
| 5,003,654 | 4/1991 | Vrzalik | 5/453 |
| 5,005,240 | 4/1991 | Vrzalik | 5/455 |
| 5,020,176 | 6/1991 | Dotson | 5/455 |
| 5,022,110 | 6/1991 | Stroh | 5/453 |
| 5,023,967 | 6/1991 | Ferrand | 5/455 |
| 5,044,029 | 9/1991 | Vrzalik | 5/453 |
| 5,095,568 | 3/1992 | Thomas et al. | 5/453 |
| 5,103,519 | 4/1992 | Masty | 5/453 |
| 5,117,518 | 6/1992 | Schild | 5/453 |
| 5,121,512 | 6/1992 | Kaufmann | 5/469 |
| 5,129,115 | 7/1992 | Higgins et al. | 5/453 |
| 5,142,719 | 9/1992 | Vrzalik | 5/453 |

FLUID FILLED FLOTATION MATTRESS

FIELD OF THE INVENTION

The present invention pertains to the field of fluid-filled mattresses, and more particularly to a quiet, self-regulating fluid mattress which will fit a variety of different, conventional bed frames and which shows very low fluid loss.

MICROFICHE APPENDICES

This application incorporates two microfiche appendices A and B, comprising a total of 5 microfiche with 351 frames.

PROPRIETARY RIGHTS NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all other copyright rights whatsoever. See 37 C F R. 1.71.

BACKGROUND OF THE INVENTION

Pressure adjustable fluid-filled mattresses are well known primarily to prevent bed sores for long-term hospital patients. Hospital beds equipped with mattresses of this type, sometimes referred to as therapeutic beds, typically have a series of transverse bags across the width of the bed filled with pressurized air. The bags are typically arranged into zones so that the air pressure in each zone can be adjusted independently to suit the weight of different parts of the body. The air pressure under the feet, for example, would normally be less than the air pressure under the hips of the patient. The theory behind the bed is that the air-filled bags conform to the shape of the user's body, and support his weight evenly. Unlike conventional beds, bony protrusions experience no more pressure than other parts of the user's body. By eliminating all the high pressure points against the person's body, the chances of developing bed sores is greatly reduced.

At present, most mattresses for therapeutic beds fall into one of two basic categories. In a high air flow mattress, each air bag is connected to a blower at one end, and to an exhaust port at the opposite end. The pressure in each bag can be regulated either by adjusting the air flow rate through an exhaust valve or through an intake valve or both. By constantly cycling air through the bags, any leakage in the bags is easily compensated for, and it is thought that the chances for infection are reduced. Any infectious bacterium or virus, as soon as it enters an air bag, is quickly blown out through the exhaust valve and often filtered out. Such a mattress is shown, for example, in U.S. Pat. No. 4,935,968 to Hunt. The air blower required to operate such a bed must necessarily be quite large, and these beds are often restricted to specially dedicated bed frames which can support the heavy air blower and the complex series of air tubes for the intake, exhaust and filtration systems.

More recently, a low air flow mattress has been developed. In a low air flow mattress, there is no exhaust valve. Instead, air escapes only through the seams and through holes and pores in the air bags. Holes are typically punched in the air bags in specific locations in order to dry the patient's skin and reduce the likelihood of maceration. The medical benefit of this is uncertain. An example of such a bed is shown in U.S. Pat. No. 4,944,060 to Peery. A low air flow mattress still leaks significantly and requires constant blower pressure to all air bags, although the size of the blower and the air flow rate is significantly less than for a high air flow mattress, resulting in a quieter, lighter, and more energy efficient mattress. The pressure in each zone is regulated by intake valves. Excess blower pressure is sometimes released through a bypass waste gate before it reaches the bags.

The existing inflatable air beds present a number of problems, many of which are made worse because the patients who use these mattresses must normally use them for a very long period of time. The constant blower operation necessary to keep the air bags full not only consumes large amounts of electricity, but is a constant annoyance to the patient. It also makes the patient difficult to transport. In order to move the bed to another location, the blower must be coupled to a portable power supply which can be moved along with the bed. Many existing beds require a dedicated bed frame which carries the blower, the tubing, the valves, any control circuitry, and a battery backup power supply. This makes for an expensive, heavy and bulky piece of equipment which is not easy to move. Existing beds also lack a convenient, secure connector for attaching the air bags to a mattress base and, if they can be moved from one hospital bed frame to another, the task is difficult and inconvenient.

SUMMARY OF THE INVENTION

The present invention provides a mattress with very low air loss. A controller monitors the pressure in each air bag zone and activates a blower to make pressure adjustments to each zone individually only when necessary. Ideally, the blower is turned off most of the time. The air bags, which are of relatively inexpensive construction, can be quickly and easily replaced and are securely held in their fittings. The entire mattress can easily be moved to almost any conventional hospital bed frame. The mattress connects to a separate, free-standing controller which is easy to operate and which can be wheeled about with the bed or hung from the bed's frame.

In one embodiment, the present invention encompasses a mattress, with a plurality of bags substantially impermeable to the flow of air, for supporting a user by containing fluid under pressure, each bag being associated with one of a plurality of fluid pressure zones. A blower supplies fluid under an adjustable pressure to the bags. A plurality of two-state valves, one for each zone, alternately allow or prevent fluid flow between the blower and each of the zones. A plurality of zone pressure sensors measure the fluid pressure in the zones, and a regulator regulates the pressure in each zone by adjusting the pressure supplied by the blower, and by opening and closing the valves in response to the measurements made by the zone pressure sensors. A CPR valve reverses the direction of flow in a duct between the bags and the blower to deflate the bags.

The bags each have a bead on one edge, and the mattress has a mattress base for supporting the bags. The mattress base has a plurality of bag attachment fittings for attaching the bags to the mattress base. Each fitting has an elongated sleeve with an interior chamber for receiving the bead of a bag, an elongated narrow slit extending along the sleeve chamber and facing away from the base, the slit being narrower than the bead of the bag but wide enough to allow the bag structure adjacent the bead to extend through the slit when the bead is received in the chamber, and an opening in the slit wider than the bead of the bag to allow the bead to be inserted into the chamber. The bead is preferably a flexible cord captured in the fabric along a bag edge. The mattress base has a plurality of grooves, each for receiving the sleeve of a bag attachment fitting.

The mattress can be secured to a variety of bed frames using a tab with a hand malleable plate bendable into a shape sufficient to grasp an edge of a bed frame, and a hinge for fastening the plate to the mattress. A unique air manifold between the blower and the bags, a unique hose coupling between the blower and the manifold, and a unique air coupling between the manifold and the bags are also provided.

The blower valves and regulator are incorporated into a controller having a housing independent of the other components of the mattress. The controller has a keyboard for inputing instructions to the regulator, a holder on the housing for receiving and holding the keyboard, and a handle on the housing. The handle is adjustable to different vertical positions, and is also adapted to receive and hold the keyboard. The keyboard also is adapted to engage the footboard of a bed frame, and the controller has wheels to allow it to be rolled using the handle. The controller is operated by a control program having a max-inflate mode, an initialize mode, an adjust mode, and a steady-state mode.

BRIEF DESCRIPTION OF THE DRAWINGS

These and other aspects of the invention will be more fully understood by referring to the following detailed description and the accompanying drawings wherein.

DETAILED DESCRIPTION

In the following detailed description of the preferred embodiments, specific terminology is used for the sake of clarity. However, the invention is not limited to the specific terms selected, but rather includes all technical equivalents functioning in a substantially similar manner to achieve a substantially similar result.

Figure 1:
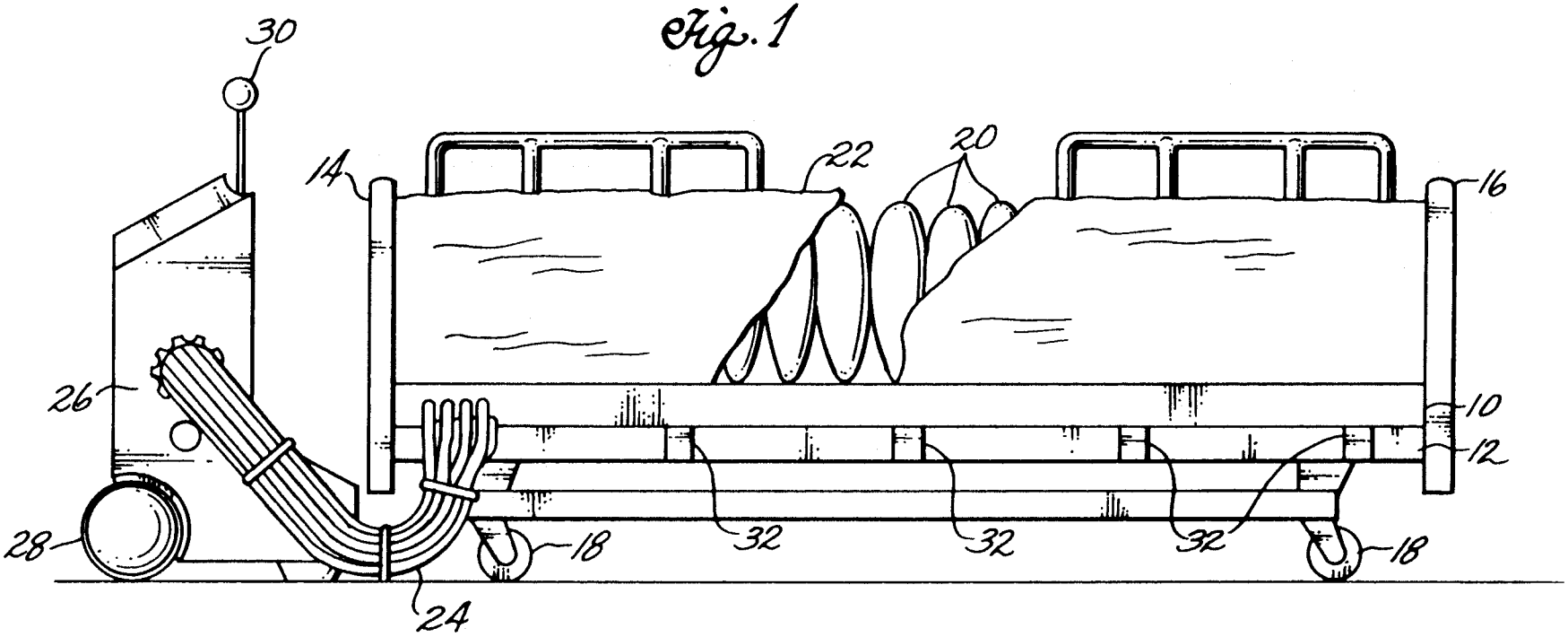
FIG. 1 is a side view of a mattress, bed frame and controller according to the present invention with the top sheet partially cut away to reveal the air bags.

As shown in FIG. 1, the present invention has a mattress base 10 which can be secured to any of a great variety of conventional hospital bed frames 12. A bed frame will typically have a footboard 14 and a headboard 16, as well as wheels 18 to allow a patient to be wheeled into different parts of a hospital. The mattress base supports a set of air bags 20 which are covered with a flexible top sheet 22. A duct 24, made up of a number of air hoses, connects into the mattress base at one end and into a controller 26 at the other. The controller has wheels 28 and a handle 30 so that it can be moved about with the bed. As explained below, the controller contains most of the hardware necessary for regulating the air pressure within the bags 20.

Figure 2:
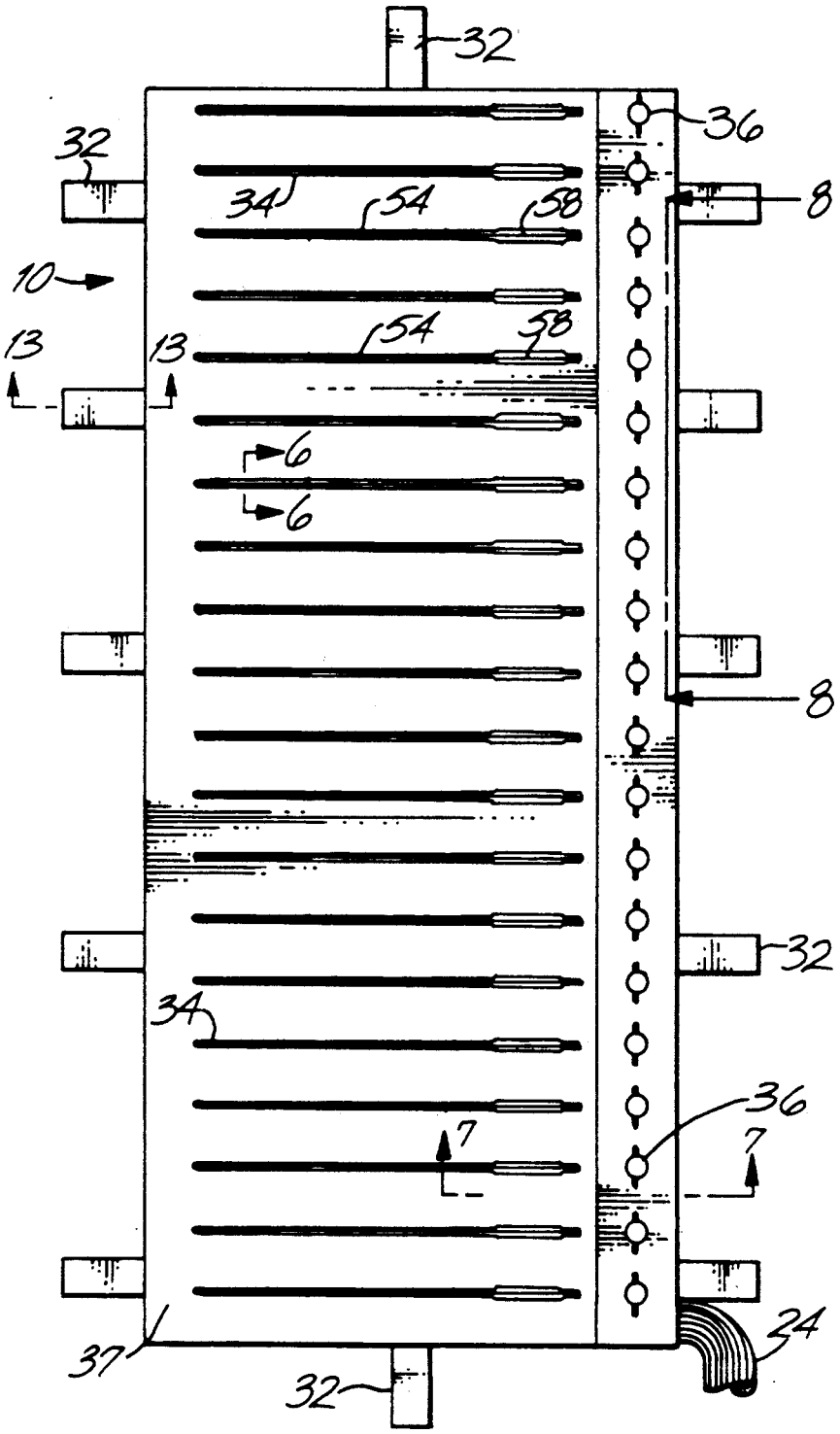
FIG. 2 is a top view of a mattress base, with the air bags removed, for use with the present invention.

The mattress base 10, as shown in FIG. 2, has a conventional rectangular shape as viewed from the top, with height and width dimensions adapted to suit a conventional hospital bed frame. There are a set of tabs 32, which can be wrapped around the edges of the bed frame to attach the mattress base to the bed frame. The mattress base has a series of elongated bag attachment fittings 34 which extend across the majority of the width of the base. These attachment fittings allow the transverse bags to be held securely in place, and are each associated with an air outlet 36. The bags are installed by sliding a bead 44 on an edge of the bag (FIG. 3) into the attachment fitting 34, and then coupling an air inlet 42 on the bag onto the adjacent outlet 36 on the mattress base. The entire mattress base is enclosed in a vinyl cover 37 that prevents the materials and cavities inside the mattress base from being contaminated by urine or other body materials. The mattress base can be CYCOLAC FBK rigid structural foam commercially available from General Electric Co., One Plastics Avenue, Pittsfield, Mass. 01201.

Figure 3:
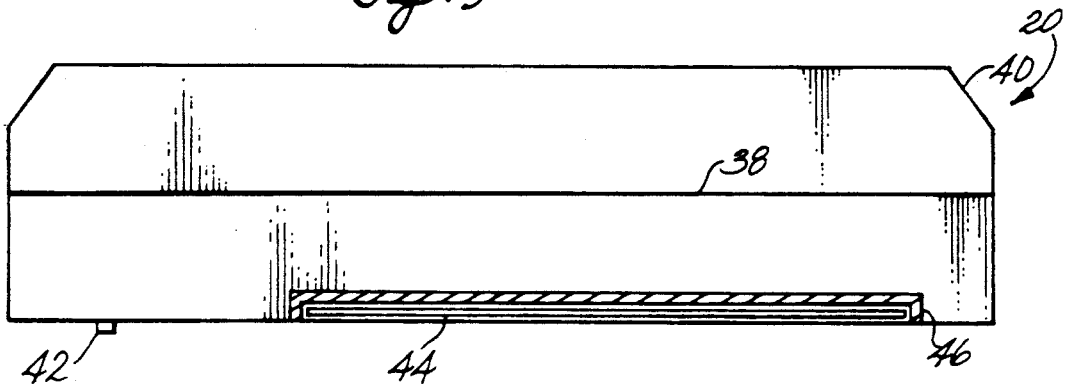
FIG. 3 is a side view of an air bag suitable for use with the mattress base of FIG. 2.
Figure 4:
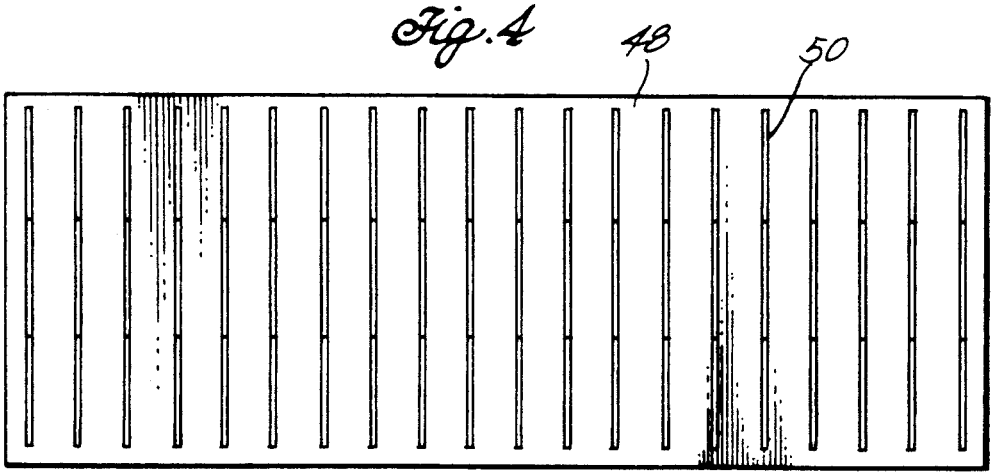
FIG. 4 is a top view of a foam substrate incorporated into the mattress base of FIG. 2.

The air bags are preferably constructed of nonallergenic, nonabsorbent, vapor-permeable, waterproof material. Since the air bags come very close to contact with the patient, it is important that the air bags not become a habitat for undesirable bacteria or viruses. It is presently preferred that each air bag be constructed from a single sheet of nylon, coated on the inside with polyurethane. Currently, a 70 denier taffeta nylon is preferred. The polyurethane coating preferably allows about 1.33 grams of water vapor per hour per square meter to pass under ASTM test E-96. The nylon sheet is wrapped around to a seam 38 on one side (FIG. 3). The seam is made on the side so that it does not contact and wear against the patient in use, and also so that it does not interfere with sealing inlet port 42. The top corners of the bags 40 are cut diagonally so that they do not present a sharp point against a patient when the patient is moving on and off the bed or if the patient falls to one side of the bed. There is an air inlet coupling 42 at a bottom end of the bag which connects to an air outlet 36 on the mattress base, and adjacent that is an elongated bead 44 which fits into one of the bag attachment fittings 34 on the mattress base. It is presently preferred that the bead be formed by placing a PVC cord 45 along the bottom edge of the bag and welding the polyurethane material of the bag together around the PVC cord 45 (FIG. 6) capturing the cord within the weld 46. This holds the cord securely in place without cuts or stitches and insures that no leaks are introduced into the bag when the cord is attached.

In contrast to other air mattresses, the air bags for the present mattress, along with all other mattress components, are preferably constructed to minimize leaking as much as possible. Accordingly, there are no stitches in the bag. All seams are formed by radio frequency (rf) welding the polyurethane coating together. The presently preferred polyurethane coated nylon material leaks very little, provided that there are no holes made in it. The air inlet coupling is also welded to the polyurethane fabric of the bag, as explained below. There are, in contrast to many prior designs, no holes cut into the top of the bag to dry the patient or allow air to be released for regulating the pressure within the bag. The top sheet 22 is preferably also constructed of the same waterproof nylon fabric, but with a different moisture permeable polyurethane coating. The top sheet fabric preferably allows about 3.02 grams of water vapor per hour per square meter to pass under ASTM test E-96. This helps prevent any moisture or liquid from the patient from coming into contact with the bags, keeping the bags and the mattress base cleaner. The greater vapor permeability reduces perspiration build up to improve comfort and reduce the risk of skin maceration. While the air bags and mattress base are easy to clean, it is much simpler to clean the single top sheet than to clean each of the bags and the mattress base. The top sheet can be dispensed with between patients to reduce the risk of cross contamination. If desired, it can be eliminated entirely. The top sheet acts like a hammock between bags, tending to pull on the user's skin and reduce his comfort.

Figure 6:
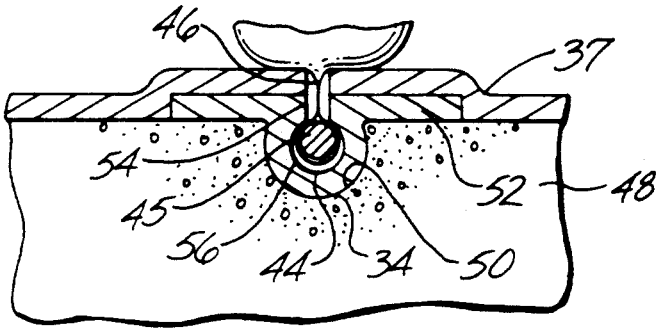
FIG. 6 is a cross-sectional view, taken along line 6—6 of FIG. 2, showing a bag attachment fitting, a bag and the foam substrate.

The mattress base 10 is preferably formed from a large sheet of resilient polyurethane foam 48 (FIG. 6). The foam sheet makes up the substrate upon which the air bags rest and is approximately four inches narrower than the surface of the bed frame upon which the substrate is to rest. The foam can comprise type UA35250-385 foam with a density of 2.5, ILD of 35 and high resiliency. Preferably the mattress base supports twenty air bags 20 along its length, and there are a corresponding number of lateral grooves 50 along the length of the foam sheet in its top surface. The grooves are die cut with the proper dimensions to contain a bag attachment fitting 34.

Figure 5:
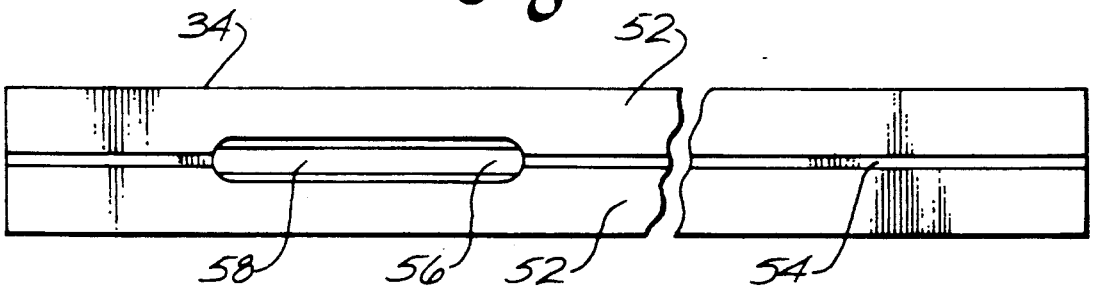
FIG. 5 is a top view of a bag attachment fitting incorporated into the mattress of FIG. 2.

As shown in FIGS. 5 and 6, the bag attachment fitting 34 has a shelf 52 on either side of a narrow slit 54. The slit provides a long, narrow opening into an interior chamber 56 within the fitting. The chamber has a cross section which is somewhat larger than the bead 44 at the bottom of the air bag, but the narrow slit 54 is narrower than the bead. The fitting has an opening 58 which allows the flexible bead on the bottom of the air bag to slide into the chamber 56. Once the bead is inserted into the attachment fitting chamber, it cannot be removed through the slit but only by sliding motion through the opening 58. The vinyl cover 37 on either end of the attachment fitting prevents the bead 44 from sliding out of the ends of the chamber so that a bag can only be removed by pulling the bead out the opening. This prevents the bags from moving from side to side laterally.

An air bag can be installed into the attachment fitting by first inserting one end of the bead into the opening 58 and then drawing the bag laterally along the narrow slit until the majority of the bead has been drawn into the chamber. When the bead reaches the end cap at one end, the opposite end of the bead is bent until it can be inserted into the chamber through the opening in the opposite direction. To remove the air bag, the bag is simply grasped near the opening and drawn upward to draw a portion of the bead out of the opening. Once a portion of the bead is out of the opening, the bag easily slides along the narrow slit until it is completely removed. The bag attachment fitting is not only simple to operate, but also holds the air bag very securely to the mattress base. It evenly distributes loads along the entire length of the bead, and eliminates movement toward the foot or head of the bed along the entire length of the bead. Conventional two-point attachment fittings often allow a bag to become partially trapped under an adjacent bag or allow the bags to inflate unevenly. Straps are sometimes used around each bag to hold the bags in line. Since the air bag attachment fittings secure the air bags along a substantial part of their length, no such problems exist with the present fittings. The bags inflate evenly and stay in their proper positions. The same attachment fitting can also be used with a bead which is not elongated. Preferably several beads would be captured in the base of the air bag which would be inserted into the chamber through the opening in the same way as the elongated bead. This may allow for simpler construction, but would only secure the bag at the specific points along the edge of the bag where the beads are placed.

As shown in FIG. 6, the shelves 52 on the bag attachment fitting extend opposite each other above the chamber 56 away from the narrow slit 54. This allows the chamber to be inserted into the grooves 50 of the foam sheet 48. The shelves then extend laterally along the top surface of the foam sheet. This helps to flatten the surface of the mattress base when the bag attachment fittings have all been inserted into place. The flatter surface distributes pressure more uniformly across the top of the mattress base, and therefore is more comfortable to lie on when the air bags are deflated. The vinyl cover 37 is wrapped around the mattress base including the bag attachment fittings and the hose and manifold components described below. The vinyl cover secures the bag attachment fittings in place on the foam and also protects the foam from absorbing any undesirable bacteria, viruses or other contaminants. As shown in FIG. 2, the vinyl cover includes a slit for each bag attachment fitting so that the bags can extend out of the bag attachment fittings when their beads are installed.

Figure 7:
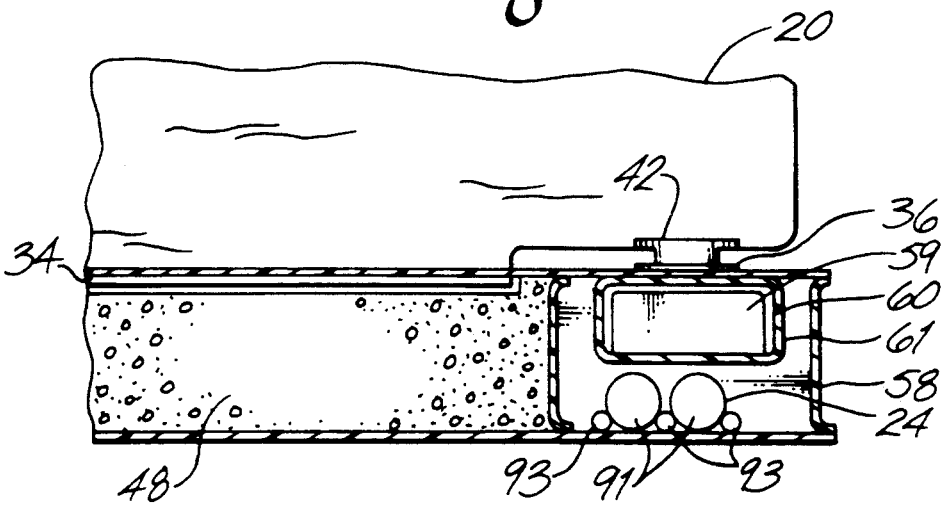
FIG. 7 is a cross-sectional view, taken along line 7—7 of FIG. 2 with an air bag attached showing the mattress base, air hoses, manifold and air bag to manifold coupling.

Each air bag is coupled through a mattress air outlet 36 to an air supply manifold 59. As shown in FIG. 7, the mattress base has a set of preferably flexible tubes or hoses 91, 93 which form the air duct 24. Above the hoses is a series of four air supply manifolds 59. The manifolds are formed by rf welding a separate sheet of vinyl 61 to the inside of the outer vinyl cover 37, to create four distinct sealed cavities within the mattress. Each manifold serves a separate uniform pressure zone. Preferably, the twenty bags 20 are divided up into four uniform pressure zones: a first zone near the user's head having four bags, a second and third zone, each having five bags, and a fourth zone near the user's feet having six bags. More or fewer zones can be provided to suit specific circumstances or the mattress can be constructed so that the air pressure inside each bag is independently controlled. Also, the mattress can be constructed with either greater than or less than a total of twenty bags 20. This is not necessary in most circumstances. It is preferred, however, that at least some variation in pressure from one area of the mattress to another be allowed for. The four zones allow for a higher air pressure to be used to support heavier parts of the patient's body. Typically, a higher pressure is desired, for example, to support the patient's hips than to support the patient's feet.

Each air supply tube 91 connects to a single one of the four independent manifolds 59 and each manifold then distributes the supplied air to the air bags associated with that zone. The supply tubes 91 extend beneath the manifolds until they reach the appropriate manifold and then have a conventional elbow (not shown) upward through the separate vinyl sheet 61 to connect near one end of the sealed vinyl air chamber of the appropriate manifold 59. Each pressure sensor tube 93 similarly connects near the opposite end of the manifold.

Figure 8:
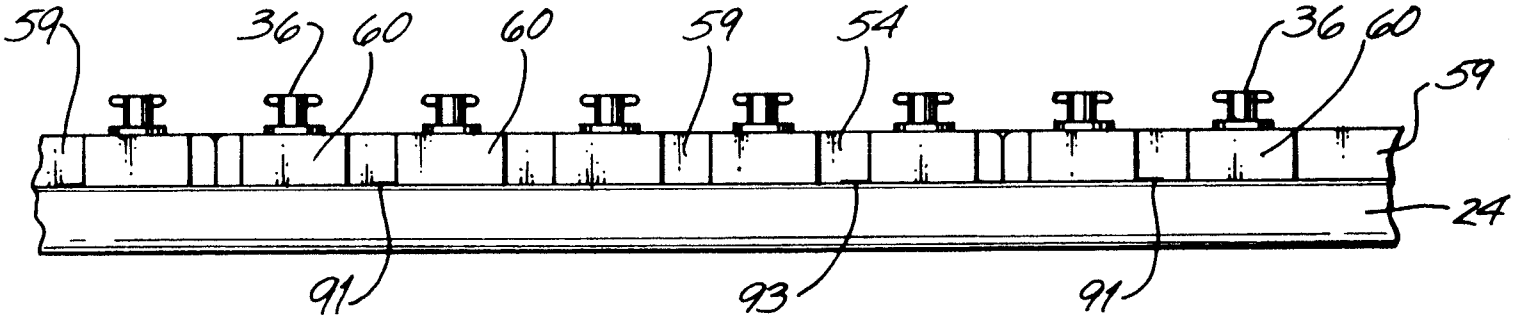
FIG. 8 is a cross-sectional view, taken along line 8—8 of FIG. 2, showing a pressure zone manifold and its frame portions.

As explained below, the air supply tubes and manifolds are used both to pump air into and out of the air bags. Accordingly, each manifold is fitted with a set of rigid frame sections 60. These frame sections, preferably formed from rigid polyvinylchloride (PVC), provide a rigid structure to maintain the shape of the chamber regardless of the pressure on the chamber. The separate vinyl sheets 61 which seal the manifold are welded to the frame sections and drawn taught across the open bottom. The vinyl sheet fabric is preferably strong enough so that it does not stretch significantly under the air pressures used to inflate the bags. As shown in FIG. 8, each frame section 60 bears a number of separate mattress air outlet couplings 36; the number corresponds to the number of air bags associated with that manifold zone. While a solid frame for each manifold or a single frame running the entire length of the mattress base can be used, this prevents the mattress from bending when the bed frame is articulated. A conventional hospital bed frame allows a patient's head, knees, and feet to be lifted, so it is preferred that the mattress and its base also be flexible. In order to ensure that the mattress can be used with a variety of different bed frames, the frames are kept short so that the mattress can flex at many different points along its entire length.

Figure 9:
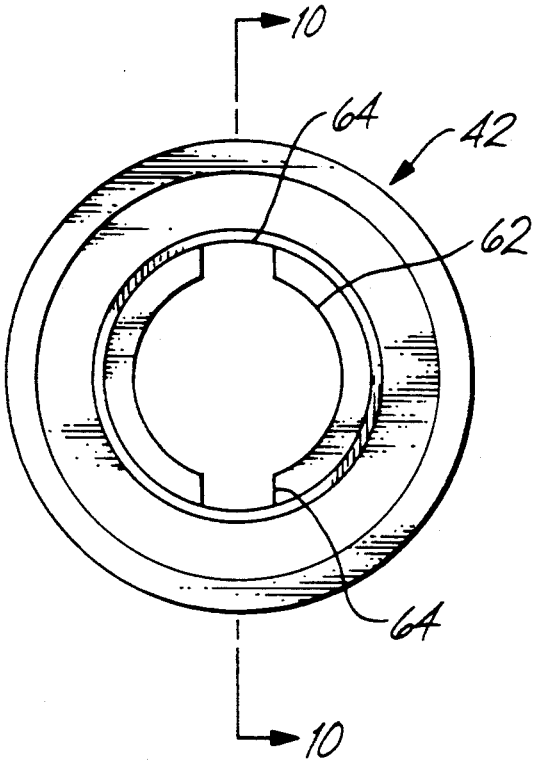
FIG. 9 is a bottom view of an air bag coupling for use in connecting an air bag to a manifold frame section.
Figure 10:
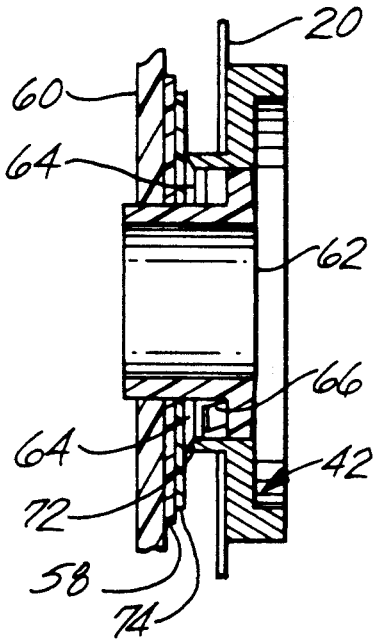
FIG. 10 is a cross-sectional view taken along line 10—10 of FIG. 9, and line 10—10 of FIG. 11, showing the air bag coupling at FIG. 9 with the manifold coupling of FIG. 11 installed into it.
Figure 11:
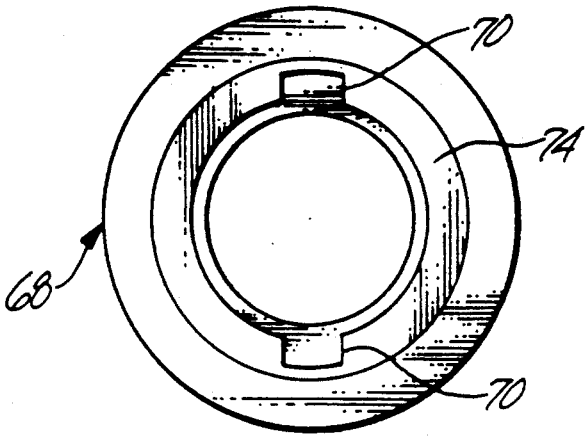
FIG. 11 is a top view of a manifold coupling for use in connecting to the air bag coupling.

FIGS. 9 and 10 show the air supply coupling 42 for an air bag in greater detail. The coupling is essentially annular with a central opening 62 and notches 64 on either side. The manifold outlet 36 (FIG. 11) has a coupling plug 68 with oppositely facing tabs 70. The coupling can be made of polycarbonate. The tabs are inserted into the notches 64 of the air bag coupling and then the two parts are rotated with respect to each other. The tabs meet a ramp 66 on the air bag coupling which draws the two coupling parts toward each other urging an outer flange 72 on the air bag coupling against a resilient washer 74 on the manifold's coupling plug. This seals the connection together and allows air to flow freely between the manifold and the air bag. After a bag 20 is installed into an attachment fitting, 34 the bag's air inlet coupling is simply placed over the manifold's plug and rotated. This completes the installation of the bag. Preferably, the slope of the ramps is chosen so that the coupling is sealed by rotation of the air bag coupling no more than ninety degrees. In order to prevent leaks around the two coupling parts, the manifold coupling plug 68 is radio frequency welded simultaneously to the fabric of the vinyl mattress base cover 37 and to the manifold frame 60. Similarly, the urethane coating on the nylon air bag fabric is radio frequency welded to the air bag coupling 42. The coupling parts are welded in place so that the air bag is not twisted when the parts are joined and sealed. The coupling parts are preferably molded from a durable plastic material which can be easily welded to the nylon and polyurethane fabrics, for example PVC or urethane. The couplings described above are preferred for their reliability and easy operation. However, any of a variety of coupling devices, known in the art, can be used instead.

Figure 12:
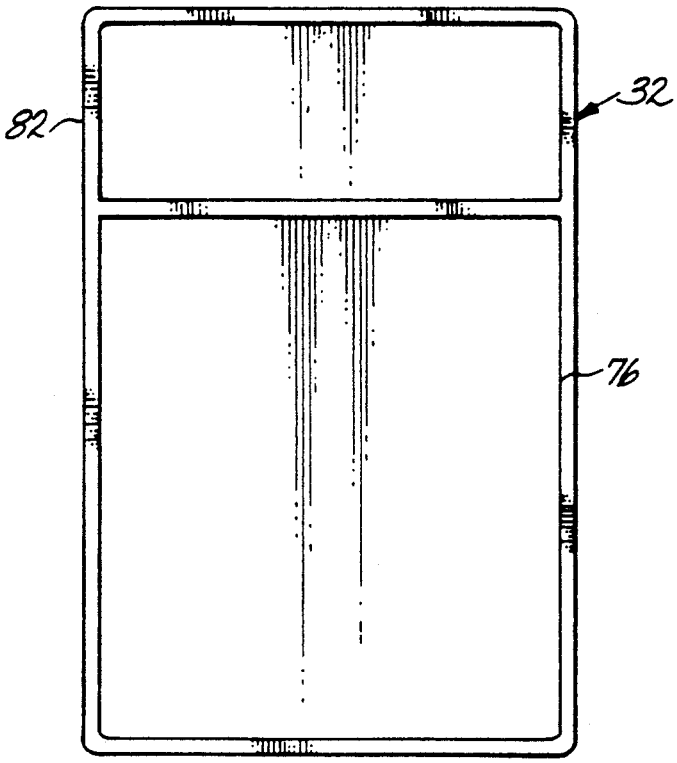
FIG. 12 is a plan view of a tab for use in securing the mattress to a bed frame.
Figure 13:
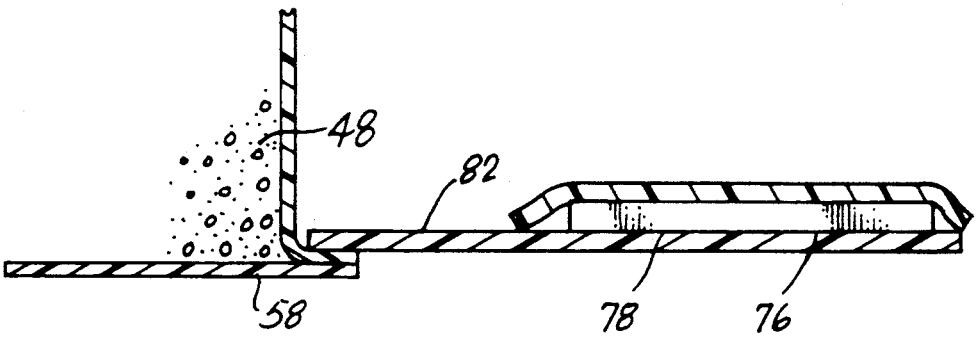
FIG. 13 is a cross-sectional view through a tab and a mattress edge along line 13—13 in FIG. 2.

As shown in FIG. 2, the mattress base preferably has a set of tabs 32 for securing it on a bed frame. The tabs extend outwardly from the outside lower edges of the mattress base at suitably spaced locations around the base. The mattress can be secured in a variety of ways using straps, ropes, snap-connected fittings and the like. In some cases, it may be possible to simply place the mattress on a conventional bed frame without any fasteners. Alternatively, a specially dedicated bed frame can be constructed for supporting the mattress base, however, this is not presently preferred because of the additional expense and inconvenience. As shown in FIG. 12, a preferred tab 32 for securing the mattress base to a bed frame is constructed from a sheet of vinyl similar to the material used as the cover 37 for the entire mattress base. The tab has a pocket 76 which contains a hand malleable aluminum plate 78 (FIG. 13). Opposite the aluminum plate, the tab is rf welded to the nylon mattress cover. The flexible vinyl fabric between the weld and the aluminum plate constitutes a hinge 82 which allows the plate to be pivoted to a variety of different positions. The tabs are used by bending the aluminum plate until it forms a hook which grasps a portion of the hospital bed frame to secure that portion of the mattress base in place. This allows the mattress to be secured to a wide variety of different hospital bed frames by bending the aluminum plate in different directions to suit particular situations. The seams on the tab are preferably rf welded in order to provide a uniform look with the nylon cover sheet. The hinge can be replaced with hooks, springs, shock cords, and a variety of other devices which can also be adapted to connect to the aluminum plate. A variety of other hand malleable materials which hold their shape can be substituted for the aluminum.

The hoses or tubes which run below the manifold include four air supply hoses 91, one for each uniform pressure zone of air bags and four pressure sensor hoses 93, one for each uniform pressure zone. The pressure sensor hoses allow the controller 26 to monitor the pressure within each uniform pressure zone. These hoses all leave the respective manifolds through conventional elbow fittings and are directed as a group to the controller. The hoses are preferably conventional, commonly available plastic tubing. Silicone rubber or PVC tubing is presently preferred. This type of tubing is inexpensive, easy to replace, and easy to clean. Transparent tubing is preferred so that the cleanliness of the tubing can be easily monitored. The tubing is preferably connected to the controller, all as a single group, and a special hose connector is preferably provided for this purpose.

Figure 14:
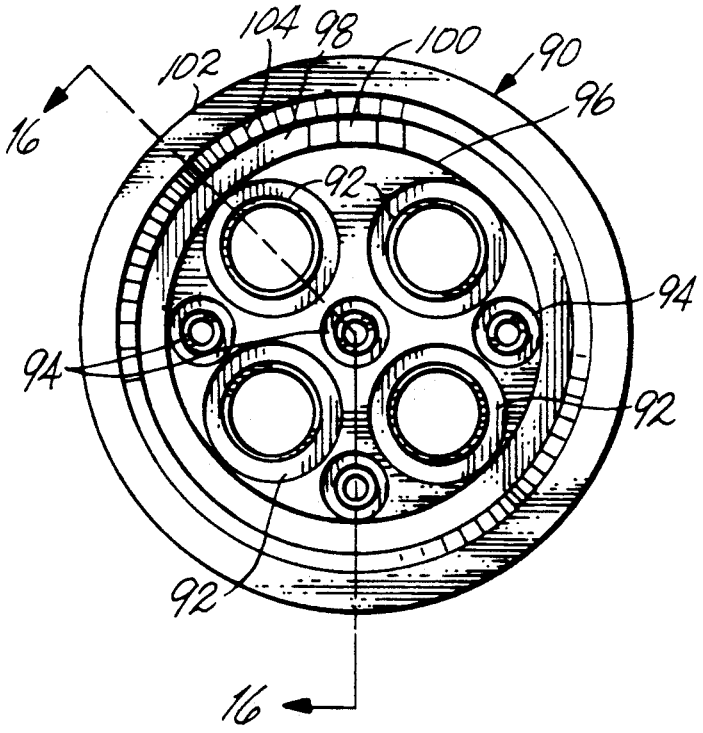
FIG. 14 is a front plan view of a hose connector with a threaded ring.
Figure 16:
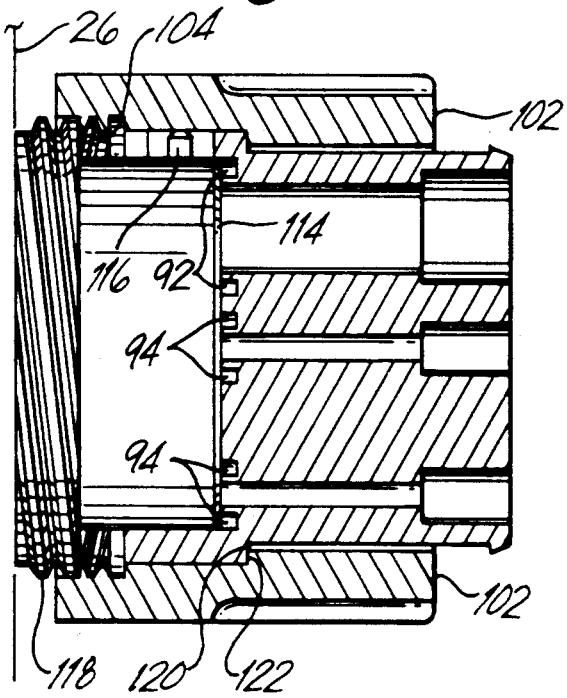
FIG. 16 is a cross-sectional view of the connector of FIG. 14 taken along line 16—16 in FIG. 14 as connected to the connector of FIG. 15 with a threaded ring.

FIG. 14 shows an end view of a first portion 90 of a hose connection which connects into the controller via connector portion 106 as shown in FIG. 16. As shown in FIG. 14, the hose connector 90 has a set of four larger annular seats 92 and a set of four smaller annular seats 94. The interior of each large seat is coupled to one of the air supply hoses 91, and the interior of each small seat is connected to one of the pressure sensor hoses 93. The seats are all mounted in a round plate 96 with a solid rim 98 that has an alignment notch 100. The entire connector portion is surrounded by a rotatable ring 102 with internal threads 104.

Figure 15:
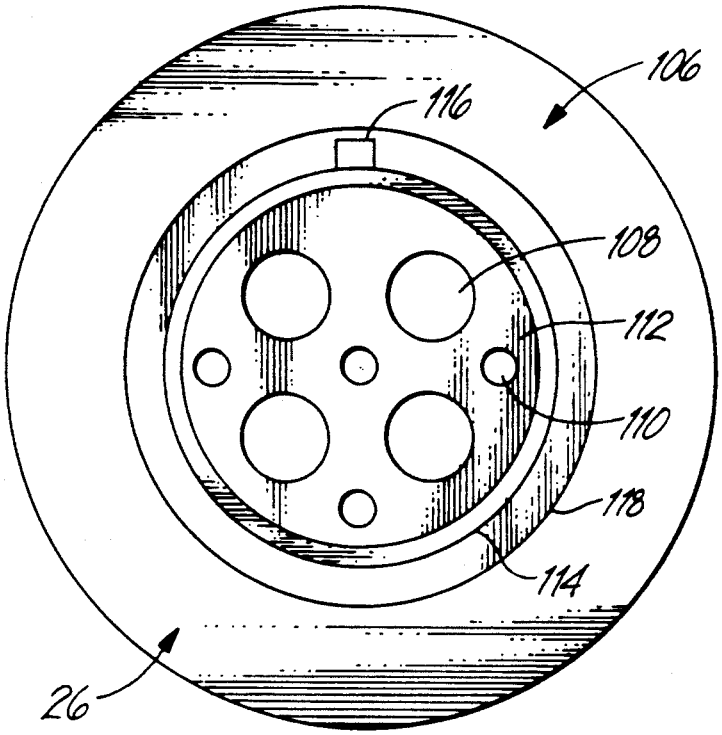
FIG. 15 is a front plan view of a second portion of a hose connector which can be mated with the connector of FIG. 14.

The other connector portion 106 (FIG. 15) is connected to the controller 26. It has a set of four hollow nipples 108 which conduct fluid from the blower and a set of small hollow nipples 110 which conduct fluid to a set of pressure sensors. These nipples are all mounted to a central round plate 112 which is surrounded by a protruding ring 114. An alignment tab 116 extends radially outward from the protruding ring. Outside of, but set back from the protruding ring is a fixed externally threaded ring 118.

The two connector portions are coupled together by pushing the first connector portion toward the second connector portion so that the protruding ring 114 travels inside the first portion's rim and the alignment tab 116 enters the alignment notch 100. This brings the nipples into contact with the seats. The connector portions are fastened together by screwing the rotatable, internally threaded ring 102 of the first portion onto the fixed, externally threaded ring 118 of the second portion. As shown in FIG. 16, the threaded ring 102 has a shoulder 120 which engages a flange 122 on the first connector portion so that, as the threaded ring 102 is screwed onto the second connector portion, it pushes the two connector portions together, pushing the nipples onto the seats to ensure a tight seal. This type of connector allows the hoses to be connected and disconnected very quickly and easily by screwing and unscrewing a single ring 102.

Figure 18:
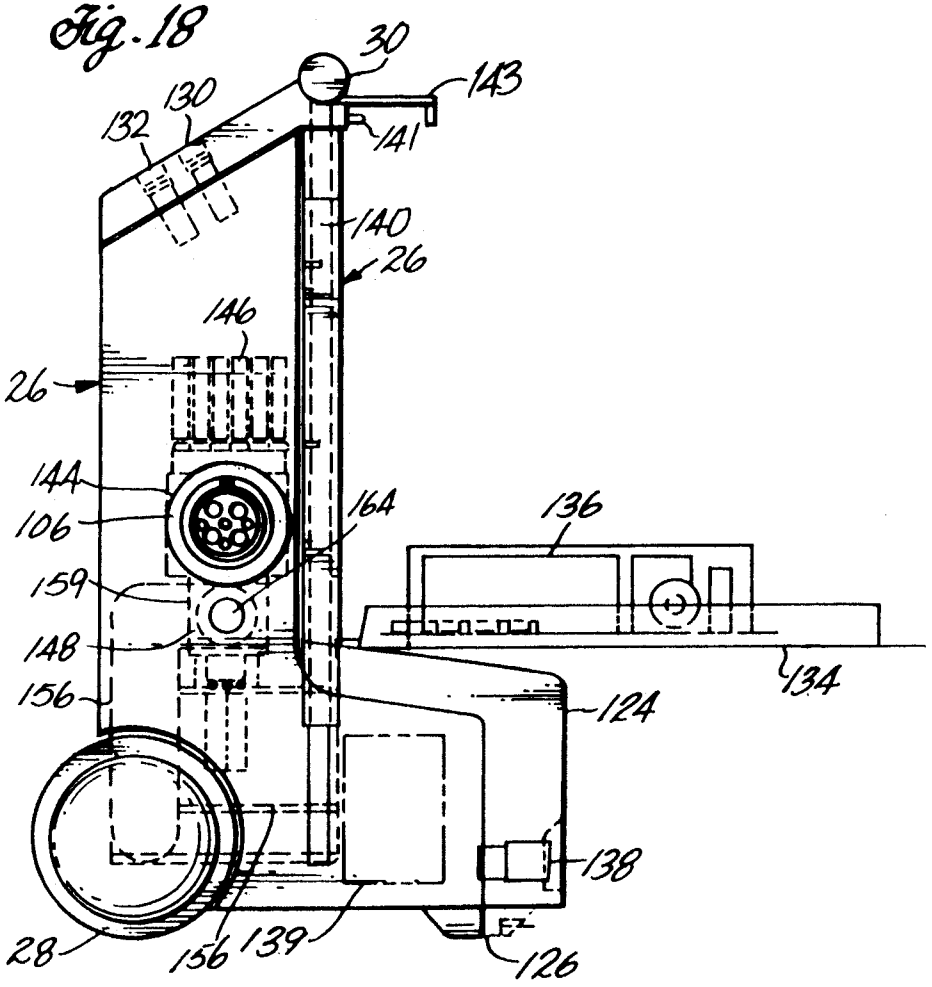
FIG. 18 is a side elevation view of the controller of FIG. 17 with its rear access panel folded downward.
Figure 17:
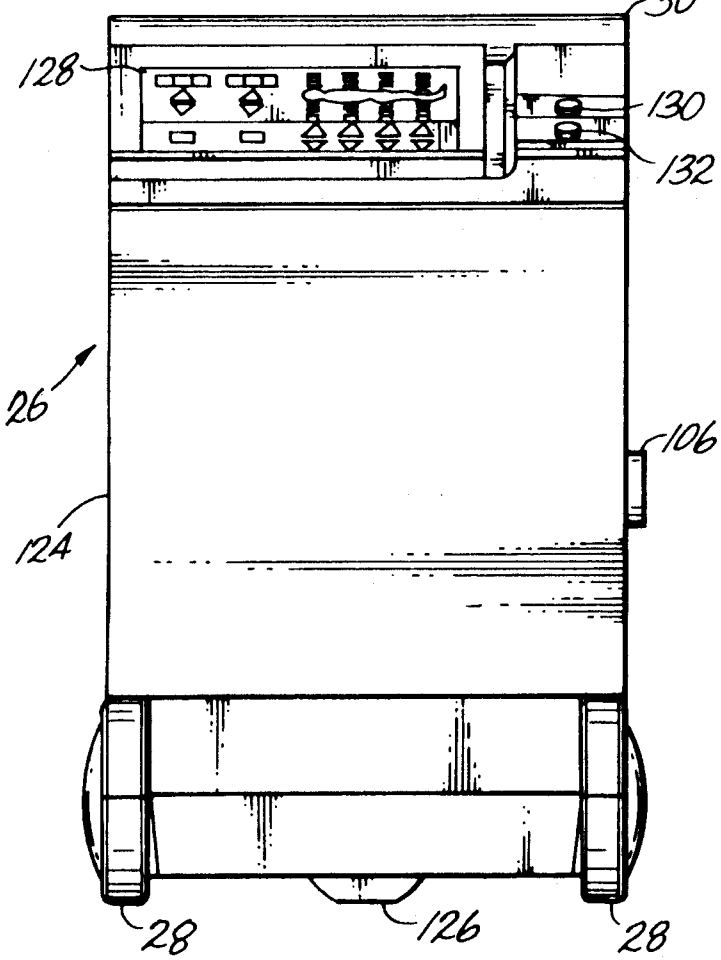
FIG. 17 is a front view of the controller.
Figure 19:
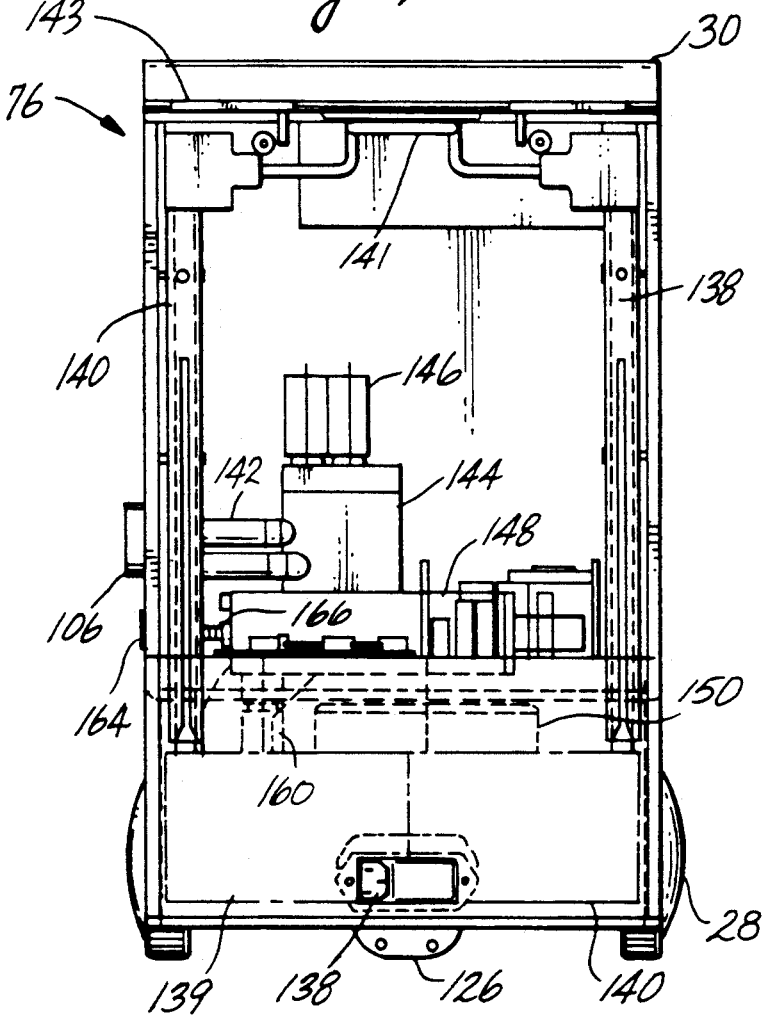
FIG. 19 is a rear view of the controller of FIG. 17 with its access panel opened.

FIGS. 17–19 show the controller 26 with the hoses disconnected. The controller incorporates most of the monitoring, regulation, feedback and control functions of the mattress into a single portable housing 124. The housing is supported by its two wheels 28 and a third leg 126 that also prevents the housing from moving about unintentionally. The front of the housing includes a keyboard 128 and two separate push buttons, an on/-off switch 130 and a cardiopulmonary resuscitation ("CPR") mode switch 132. The function of these switches will be explained in greater detail below. As best seen in FIGS. 18 and 19, the housing for the controller includes a rear fold-down access panel 134 upon which most of the controller's electronics 136 are mounted for easy access. Near the controller's leg is a conventional AC outlet and power supply 138 and a battery back-up system 139 consisting of a pair of batteries and back-up transformers. A separate access panel (not shown) provides access to the battery area. Normally, the controller is operated from the standard current net, i.e., conventional local AC power; however, in the event of a power failure or when a user is in transit on the mattress, the battery back-up system is employed to regulate the air bag pressure. Naturally, because the blower is normally off, much smaller batteries are required than with prior designs, reducing weight, size and cost.

The handle 30 is a horizontal bar with a pair of long vertical legs 140, one on either side, which extend into the housing. The handle is locked in place by a spring mechanism and can be moved to any desired vertical position by pushing a handle adjustment lever 141, unlocking the handle, moving the handle while the lever is depressed, and then when the desired position is reached, releasing the adjustment lever. The handle includes a pair of hooks 143 which extend rearward from the handle. The hooks allow the controller to be hung from the footboard of a bed. This eases transportation of the mattress and bed frame. The hooks are preferably formed from plates through which the vertical legs of the handle extend. The hooks can be rotated inward out of the way when not in use (FIG. 19).

Figure 20:
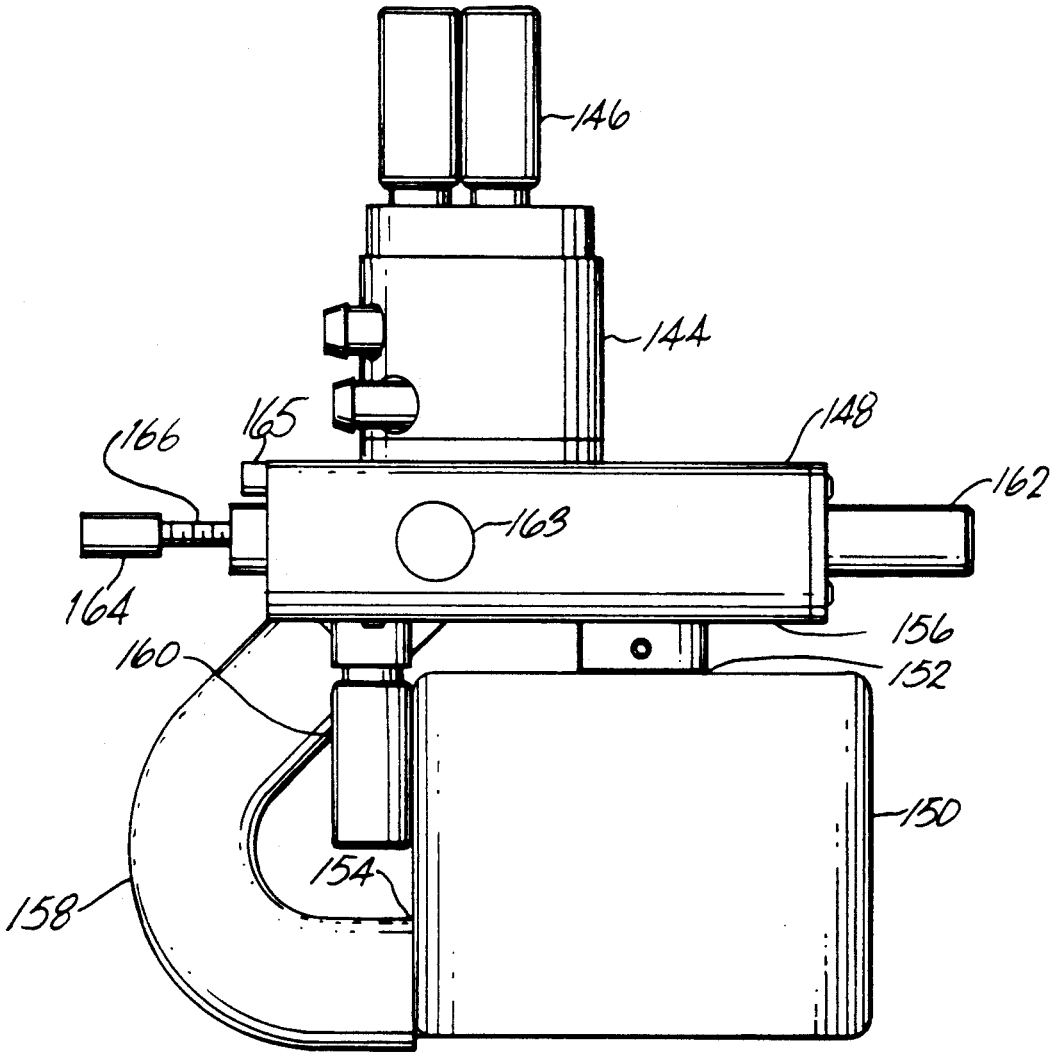
FIG. 20 is a view of the blower, CPR valve and solenoids removed from the controller of FIG. 17.

The hose connector 106 is preferably attached to the side of the housing and connects the air supply hoses through a set of short transparent plastic hoses 142 to four way valve manifold unit 144. The valves are non throttling, two-state, bistable ON/OFF valves, and are operated by a set of four independent solenoids 146. The valves are normally closed, but upon activation of the respective solenoids, are fully opened to connect the corresponding air hose with the controller's air supply. The four-way valve unit is connected to a CPR valve 148 which is connected to a blower 150. The blower is the source of all air pressure for the system and is operated from the AC outlet or the battery power supply. The blower is preferably a multi-phase variable speed blower which can be operated at different speeds to produce different air pressures. The blower preferably is a 24 v.d.c. model producing 29.29 in Hg at 70 degrees F., and can be Model No. 116976-00 available from Ametek/Lamb Electric Division, 627 Lake Street, Box 1599, Kent, Ohio 44240-1599. However, a variety of other multi-phase variable speed blowers can be used instead. Alternatively, any other type of blower or fluid pump capable of producing an adjustable fluid pressure or volume flow rate at its outlet can be used. The pressure or flow rate need not be speed dependent. The blower has a single low-pressure inlet port 152 and a single high-pressure outlet port 154 (FIG. 20). These are both connected directly to the CPR valve 148. The CPR valve is a 2-position, 4-way slide valve which is solenoid-triggered and spring biased with manual reset. In the first position, the valve connects the blower low-pressure inlet port to atmosphere and the outlet port to the system. In the other position, the blower operates as a vacuum source and the slide valve connects the inlet port to the system and the outlet port to atmosphere, as discussed below. The release solenoid 160 can be obtained as Model No. LT8x16-DC from Guardian Electric Manufacturing Co., 1425 Lake Avenue, Woodstock, Ill. 60098.

In normal operation, when an air bag needs to be inflated, air is drawn through the controller housing into an ambient air inlet 156 of the CPR valve. From there it is directed into the blower through the low-pressure inlet where it is compressed and pushed out the blower's high-pressure outlet. A high-pressure air hose 158 (FIG. 20) connects the air from the blower outlet into a high-pressure inlet 159 in the CPR valve (FIG. 18). The CPR valve then conducts this air into the four way manifold unit 144 from which the air is conducted to the air bags. The purpose of the CPR valve is, when need be, to reverse the direction of the air flow between it and the blower.

If a patient using the bed suffers a cardiac arrest, it may become necessary to administer cardiopulmonary resuscitation (CPR) which is difficult to perform when the air bags are inflated. The air bags do not provide a sufficiently rigid surface (such as the hard support backing beneath the mattress) to allow the chest compressions of CPR to have their proper effect. When CPR is necessary, an operator depresses the CPR mode switch 132 on the front of the controller housing. This directly activates a CPR release solenoid 160 which briefly draws a spring-loaded rod against the force of the spring away from the CPR valve body, unlatching the valve. Once unlatched, the valve, under the force of a different spring in a spring housing 162, is driven toward the left in FIG. 20 to its CPR position. In the CPR position, the blower's low-pressure inlet 152 is connected directly through the CPR valve to the four-way manifold unit 144 and the high-pressure outlet is connected to a CPR exhaust port 163 which vents air from the bags to the atmosphere. A switch 165 is tripped when the CPR valve is in the CPR position and sends a signal to a regulator 172, shown in FIG. 21 and described in more detail below. The regulator instructs the blower to operate at its maximum speed. This reverses the normal flow of air from the blower toward the air bags to a flow from the air bags to the blower. The blower, with the help of the patient's weight, quickly deflates the air bags so that the patient comes to rest on the padded foam mattress base. The function of the CPR valve can also be achieved using a reversible blower capable of operating in the opposite direction so that the high-pressure outlet becomes the low-pressure inlet and vice versa.

During the administration of CPR, it is particularly advantageous that the mattress base include the foam substrate described above and that the air bag attachment fittings be recessed into grooves in the foam layer. The shelves 52 on either side of the bag attachment fittings greatly reduce the sharpness of the otherwise narrow fittings. To restore the mattress back to normal operation, a CPR release mode knob 164, which extends from the controller housing below the hose connector 106, is pushed. This knob is connected to a valve rod 166 which connects to the CPR valve body. When the CPR valve is released and travels under the force of the spring 162, the CPR valve rod 166 travels with it. This causes the CPR release mode knob to be pushed outward away from the exterior of the controller housing. Pushing the knob in toward the housing manually pushes the CPR valve back into its normal position and allows the spring-loaded latch solenoid 160 to move back up to latch the valve in its normal position. With the valve back in its normal position, the blower outlet is again connected to the four-way valve manifold unit, and the blower inlet is connected to ambient air.

Figure 21:
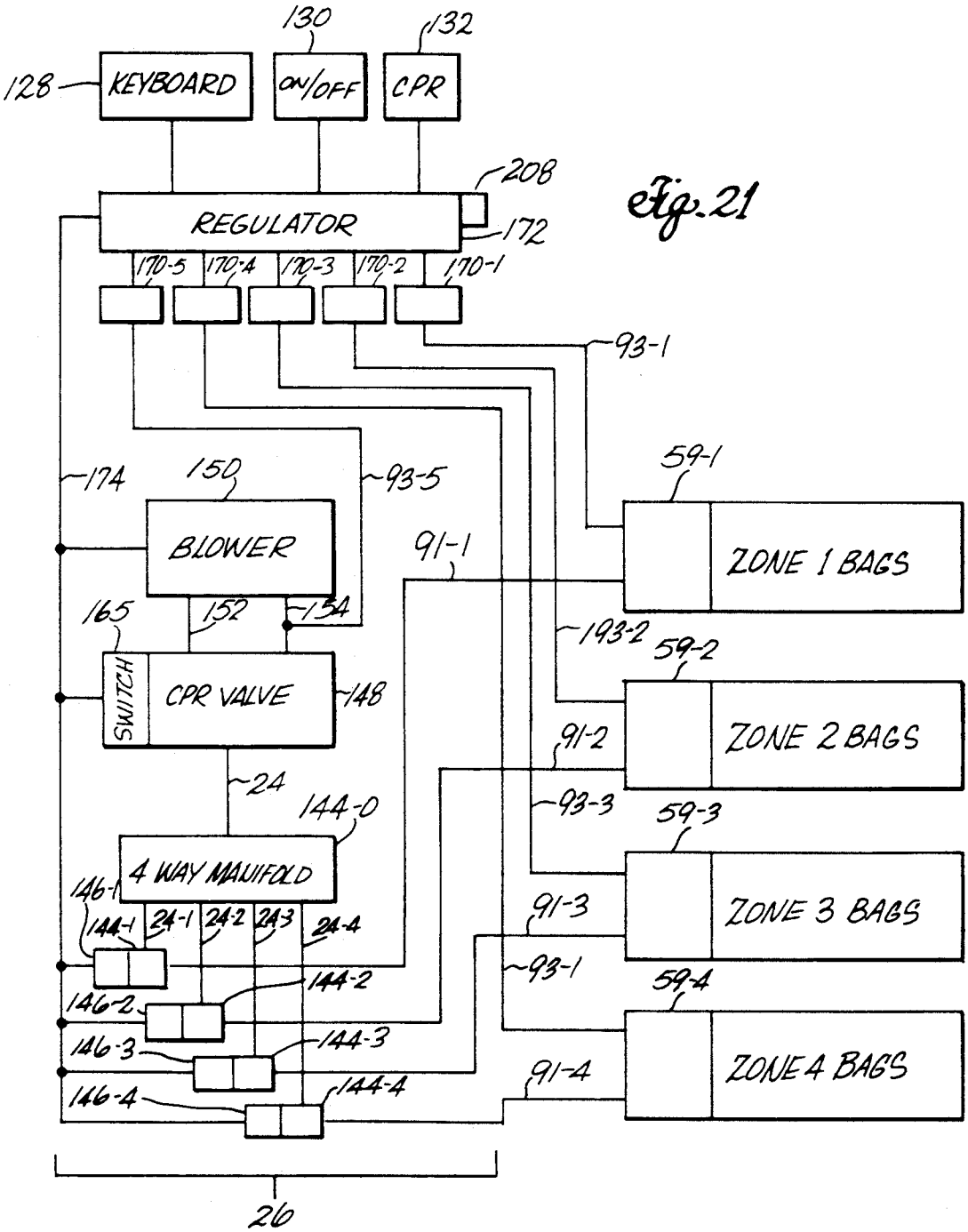
FIG. 21 is a functional block diagram of the mattress and controller system showing the operation of the mattress.

The basic operation of the mattress is best understood referring to FIG. 21. As explained above, the controller 26 includes a blower 150 for supplying air to the air bags, a CPR valve 148, and a four-way manifold and valve unit 144, 146. This unit includes a four-way manifold 144-0 and four separate, normally closed, solenoid-operated bistable valves 144-1, 144-2, 144-3, and 144-4. The duct 24, which conducts air between the blower and the air bags, breaks into four separate parts, 24-1, 24-2, 24-3, and 24-4, between the four-way manifold 144-0 and the valves. The duct continues from the valves to the corresponding mattress base manifold 59-1 to 59-4 for each valve. Between the valves and the manifolds, the duct is in the form of transparent plastic tubing as the air supply tubes 91-1 to 91-4 described above. Each portion of the duct enters a respective manifold to conduct air between the blower and the air bags in the corresponding uniform pressure zone.

The pressure sensor tubing part of the duct 93-1 to 93-4 is connected at the opposite end of each manifold from the air supply tubes to conduct air between the manifolds and pressure sensors in the controller. As described above with respect to FIGS. 14, 15, and 16, the pressure sensor tubing is preferably connected to the controller in the same location as the air supply tubing. Once inside the controller housing, the pressure sensor tubing is separated from the air flow duct so that it can be connected to the corresponding electronic pressure sensor transducer 170-1, 170-2, 170-3, 170-4. A piezoelectric or electric diaphragm type of sensor which produces an analog voltage signal in response to pressure in the tubing, for example, Microswitch Model No. 136PC01G2 is presently preferred, although a great variety of different pressure sensors may be used. A fifth pressure sensor 170-5 is connected to a fifth pressure sensor tube 93-5 which is in fluid communication with the blower high-pressure outlet. Alternatively, a pressure sensor can be provided in each manifold and connected electrically to the controller.

All of the pressure sensors are connected to a regulator 172 which monitors the pressure output of the blower, as well as the pressure in each uniform pressure zone of the mattress. The regulator includes a suitably programmed digital microprocessor located within the controller, along with the appropriate memory, power supply and interface circuitry. The pressure sensors are preferably mounted to the same circuit board as the regulator. The regulator is also connected to the keyboard 128, the on/off switch 130, and the CPR switch 132 and transmits control signals to components in the controller housing 26. The regulator has a control line 174 to the blower which allows it to turn the blower on and off and to regulate its operation rate. It has a detect line to the CPR valve release switch 165 which allows it to determine the position of the CPR valve, and it has a control line to each of the four independent valve solenoids 146-1, 146-2, 146-3, 146-4, to allow it to open and close the corresponding valves 144. It is preferred that the CPR switch have a direct connection (not shown) to operate the CPR valve release solenoid so that the CPR mode can be engaged even if the regulator malfunctions.

CONTROLLER AND CONTROL PROGRAM

The controller can be constructed using a main control board handling a 24 v.d.c. input at 10 amps and producing outputs of +5.1 v.d.c. at 1 amp, +/−12 v.d.c. at 100 ma, and +5.75 v.d.c. at 750 ma. The keyboard can be a membrane switch keyboard rated 5.75 v at 750 ma. The power supply can be Model No. V250D06 available from Deltron, Inc., P.O. Box 1369, Wissahickon Avenue, North Wales, Pa. 19454, rated at 24 v.d.c. at 11 amps. The supply can be coupled to a power input module rated at 5 amps, with RFI filtering, Model No. 5EHM1 from Corcom, 1600 Winchester Road, Libertyville, Ill. 60048. The power switch can be a three pole, alternate action switch rated 5 amps at 250 volts, Model No. TH42-233 from C&K/Unimax, P.O. Box 152, Ives Road, Wallingford, Conn. 06492-0152. A suitable CPR switch, rated 5 amps at 250 volts, single pole momentary action type, is available as Model No. TH42-131 from C&K/Unimax. The batteries preferably comprise Model No. LCR12V6.5, rated at 12 volts at 6.5 amp-hours, from Matsushita Electric Industrial Co., Ltd., Kadoma, Osaka, Japan.

Figure 26:
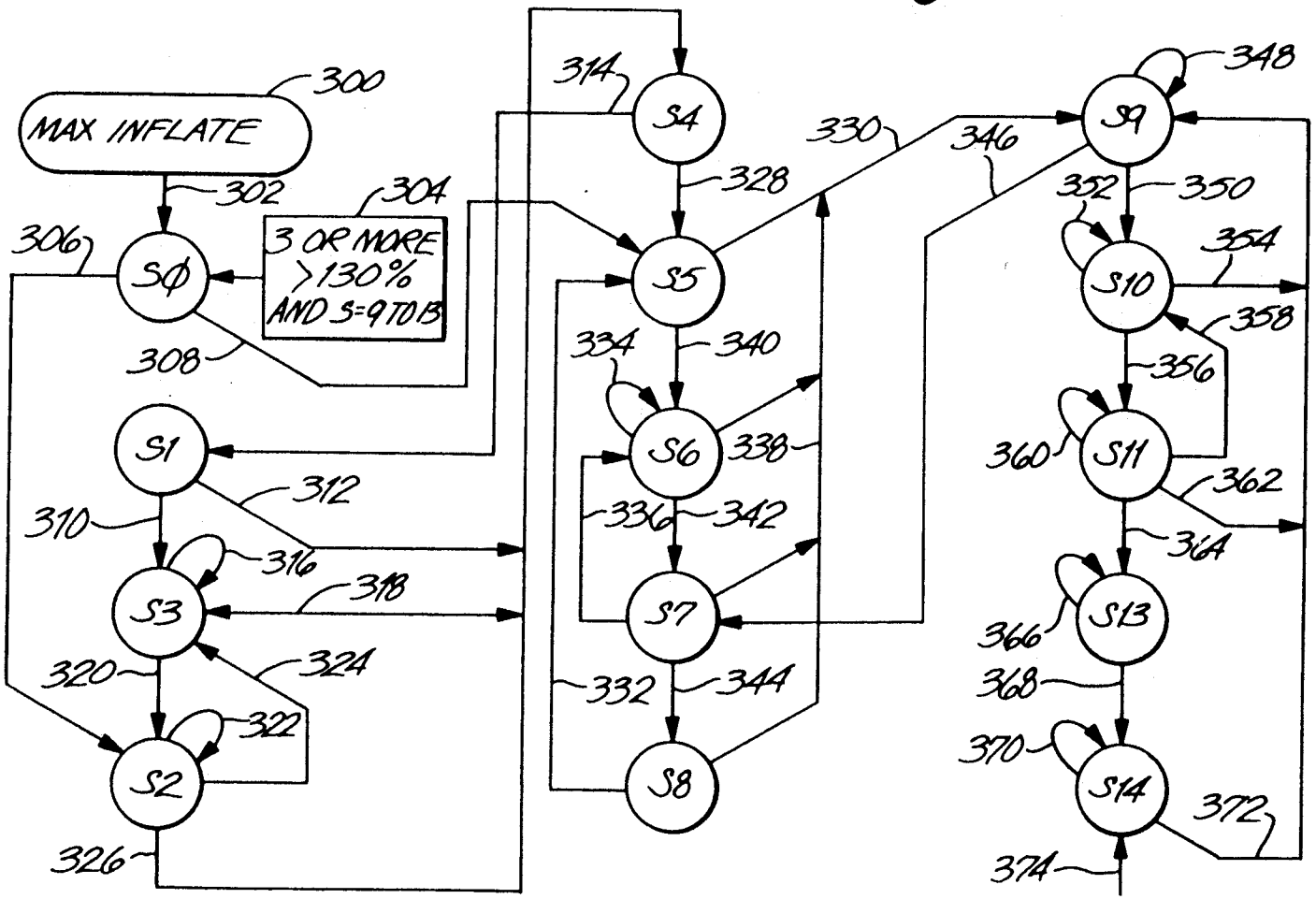
FIG. 26A is a flow diagram showing primary modes of a data processing method used to control the apparatus.
FIG. 26B is a state diagram of a data processing method used to control pressure adjustment of the apparatus.
Figure 26A:
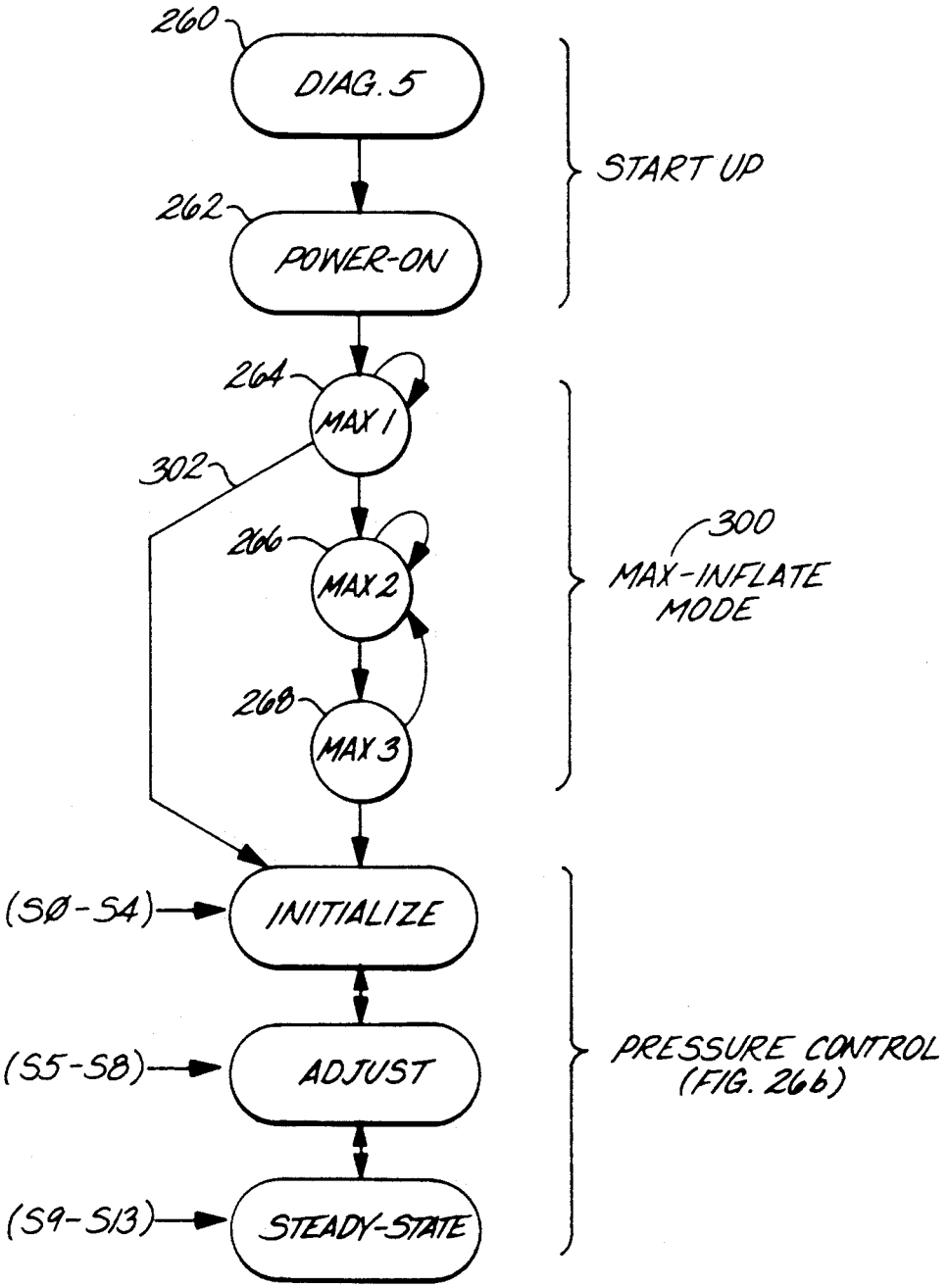
Figure 26B:
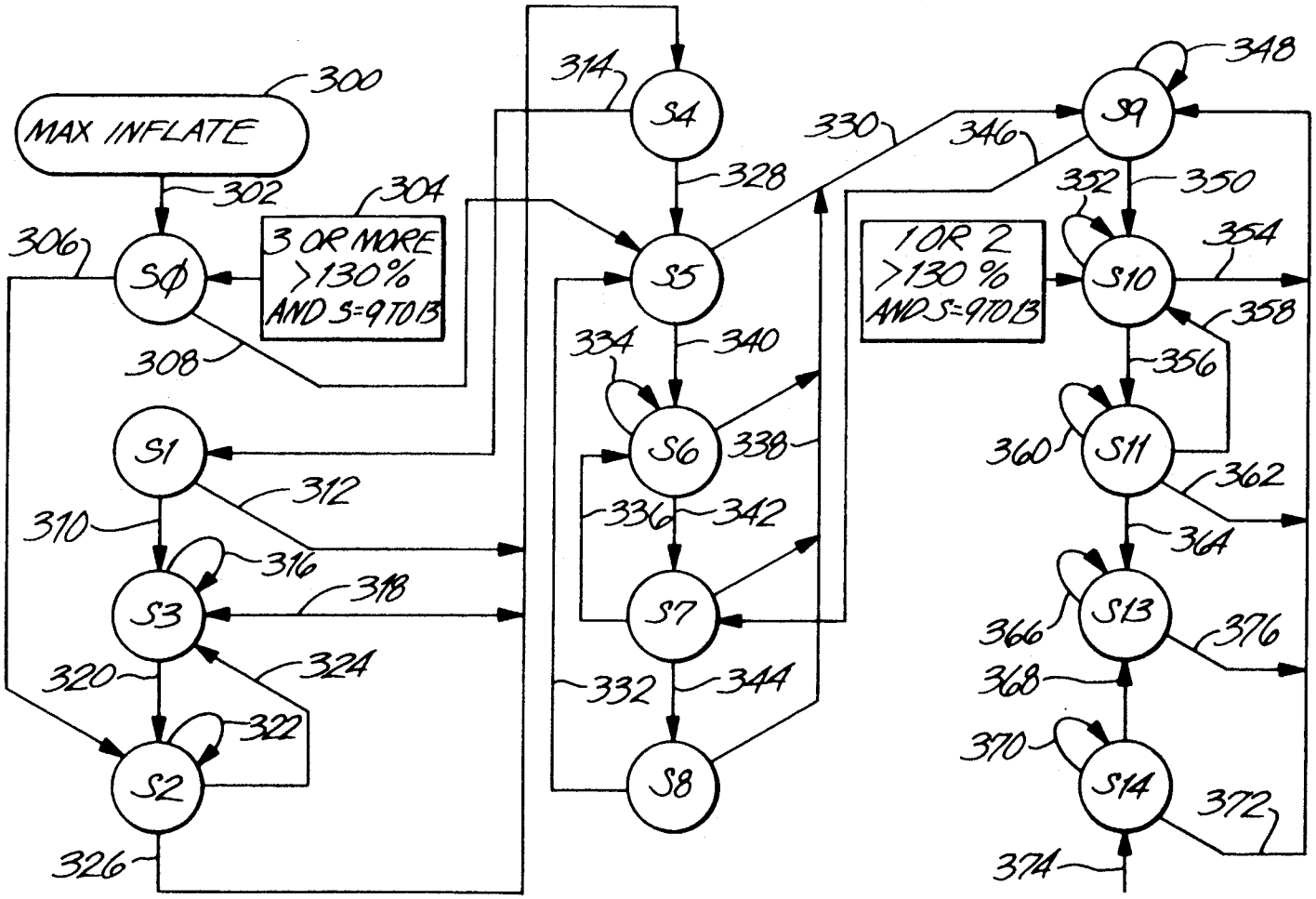

Computer control and operation of the apparatus is preferably accomplished using a computer program operable to implement the diagrams of FIGS. 26A and 26B. Suitable computer programs are shown in Appendix A and Appendix B. Appendix A is a first mode whereas Appendix B discloses a second, preferred mode of the program.

The control programs cause the apparatus to operate in six primary modes shown in FIG. 26A. A diagnostic mode 260 and a power-on mode 262 are executed upon power-up. A max-inflate mode 300 is then executed, followed by an initialize mode (states S0 to S4 of FIG. 26B), a gross adjust mode (S5 to S8), and a steady-state mode (S9 to S13).

1. Power-up Diagnostic Mode

When power is applied to the mattress the controller enters a power-up diagnostic mode 260. The microprocessor in the controller tests the internal electronic hardware. If any tests fail, the mode terminates and a number corresponding to the failed test is displayed on the controller display. An endless loop ensues, requiring the user to turn off the apparatus and fix the problem.

If the tests pass, control is passed to the power-on mode 262. Default patient weight and height values are displayed. This mode is maintained until the user presses the weight and height adjust keys at least once to establish a patient profile (discussed below). Thereafter control is passed to the max-inflate mode.

2. Max-Inflate Mode

When the mattress is first turned on using the on/off switch 130, an operator normally presses a MAX INFLATE key on the keyboard and the mattress operates in a max-inflate mode represented by states MAX 1, MAX 2, MAX 3 of FIG. 26A (collectively shown by state 300 of FIG. 26B). In the MAX 1 state 264 all the solenoid valves 144 are opened seriatim and then the blower is turned on to its maximum operation rate. This inflates all of the air bags in each zone (preferably to at least 25.0 mm Hg) as quickly as possible. The max-inflate mode is continued for a predetermined amount of time, or until a key on the keyboard is pressed, and then the regulator switches operation on path 302 of FIG. 26B to the initialize mode.

During MAX 1 an internal timer runs. After 50 seconds, internal pressures in all four zones are tested. If any zone is under 2.0 mm Hg, an alarm condition is announced on the display and control is passed to the MAX 2 state. The same occurs if any zone is less than 19.2 mm Hg after between 90 to 300 seconds.

In the MAX 2 state 265, the blower and solenoids are operated as in MAX 1, but the timer is disabled. When all zones are over 19.2 mm Hg, control is passed back to MAX 1. If any zone falls below 19.2 mm Hg, an alarm condition is announced and control remains in MAX 2.

State 268 (MAX 3) is entered only if the mean pressure of two zones is at least 25% below the desired pressure or the mean of one zone is 80% below desired. The blower is set to a lower value than in MAX 1 or MAX 2, but still high enough to fill all zones above 20 mm Hg. All solenoids are opened and the timer is set to 15 seconds. After the timer expires, the zones are checked and if any is below 19.2 mm Hg, an alarm condition is announced and control is passed to MAX 2. Thus, MAX 3 allows quick recovery from very low zone pressures without signaling a system failure due to a leak.

Figure 22:
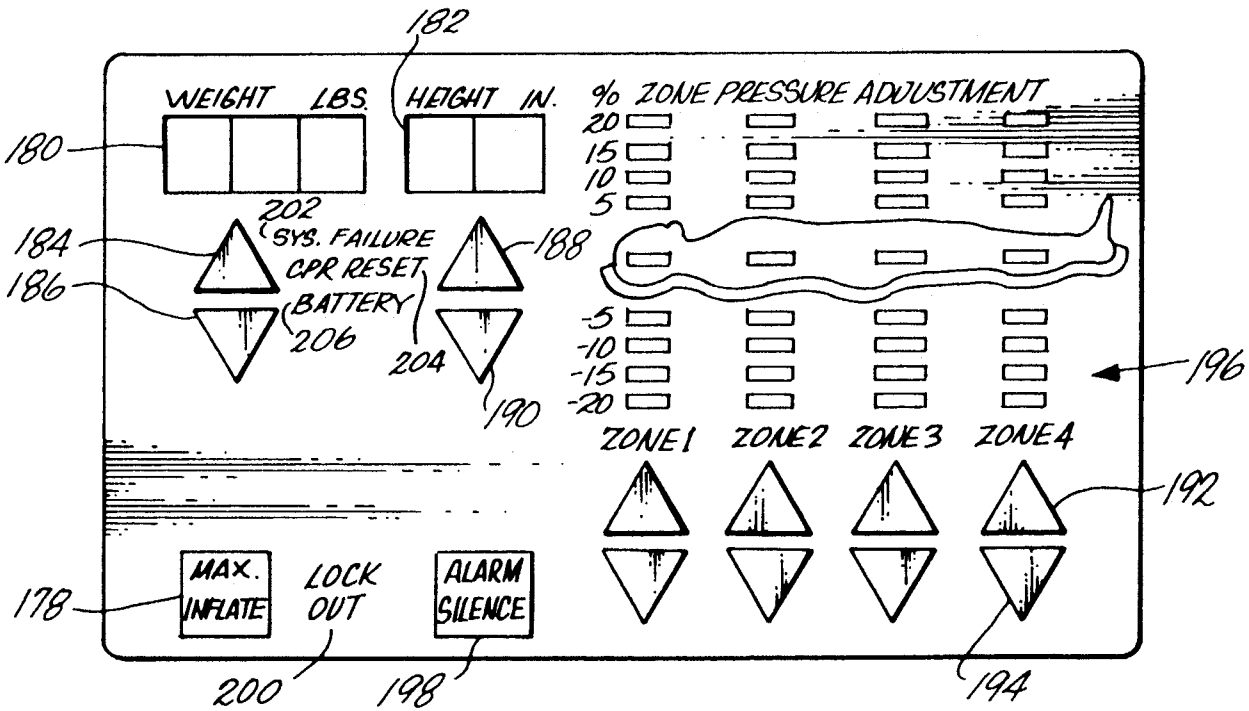
FIG. 22 is a front view of the keyboard of the controller of FIG. 17.

In the preferred embodiment, the max-inflate mode 300 continues for approximately five minutes. The max-inflate mode can be selected by an operator at any time by pressing the max-inflate button 178 on the keyboard (FIG. 22). Thus, the max-inflate mode may be used not only to inflate the air bags quickly, but also to make it easier to move a patient on or off the bed and to perform other tasks, since the max-inflate mode establishes the firmest possible condition in all zones of the mattress.

3. Initialization Mode

After termination of the max-inflate mode (i.e. when max-inflate time expires or a keyboard key is pressed), an initialization mode begins as shown by states S0 to S4 of FIG. 26B. The initialize mode causes the blower pressure (and all four zones) to decrease at a steady rate. As each zone reaches its desired pressure plus an offset, the valve solenoid is closed for that zone and the blower is further decremented. As indicated in block 304, state S0 is entered only when the mean pressure of three or more zones is greater than 130% of the desired pressure, and the current state is any of states S9 to S13 of FIG. 26. In state SO, the zone with the highest desired pressure is determined (this zone, and any other zone of interest at a particular point in the state diagram, is designated herein as zone $Z_I$). The blower is set to zone $Z_I$'s desired pressure, all the valve solenoids are opened, and a delay variable is set to 8. This permits excess pressure to bleed out of all zones at pressures greater than $Z_I$ (i.e., until the delay variable reaches zero).

In the programs of Appendices A and B, the desired pressure of a zone $Z_I$ is stored in an array or vector variable ZoneDesired($Z_I$). Similarly, the actual pressure of a zone is referred to as ZoneActual($Z_I$). The mean pressure of a zone is stored in ZoneMean($Z_I$). The actual or current blower pressure is stored in a variable BlowerActual. When pressure in a zone falls outside a desired 90%/110% window, the zone is flagged in ZoneBadCounts($Z_I$).

If the mean pressure of any zone is less than 19 mm of mercury (an exceptional condition), control passes on path 308 to state S5 (discussed below). Otherwise, control passes on path 306 to state S2 in which the delay variable is decremented by one. If the delay variable is greater than zero, control remains in state S2 as indicated by path 322. Usually, states S1, S3, S2, and S4 are entered seriatim four times (once for each zone) after which state S5 is entered. At any time, if all four zones are in the desired 90% to 130% window, control is passed to state S9.

In state S1, the zone $Z_I$ with the highest desired pressure (and not yet initialized) is determined. The blower is set to zone $Z_I$'s desired pressure, and the delay variable is set to 8. Control is passed on path 312 to state S4 if the actual pressure of a zone $Z_I$ falls within the following range:

$$\text{ZoneDesired}(Z_I)+\text{Offset}(Z_I)-15<\text{ZoneActual}(Z_I)<\text{ZoneDesired}(Z_I)+\text{Offset}(Z_I)$$

Otherwise, control is passed to state S3 on path 310.

In state S3, the logical steps of the following pseudocode are carried out:

```
if    (ZoneActual < ZoneDesired + Offset − 15) then
      if ((Z_I=1) or (Z_I=4)) then IncrementBlower 6;
      else if ((Z_I=2) or (Z_I=3)) then IncrementBlower 12;
else  if ((ZoneActual > ZoneDesired + Offset) then
      if ((Z_I=1) or (Z_I=4)) then Turn Off Blower;
      else if ((Z_I=2) or (Z_I=3) then Decrement Blower 12.
```

This logic recognizes that the head and foot zones (zones 1 and 4) usually require less inflation pressure than zones supporting the torso and upper legs (zones 2 and 3). Control remains in state S3, on path 316, if:

$$\text{ZoneActual}(Z_I)<\text{ZoneDesired}(Z_I)+\text{Offset}(Z_I)-15.$$

Control is passed to state S2 on path 320 if:

$$\text{ZoneActual}(Z_I)>\text{ZoneDesired}(Z_I)+\text{Offset}(Z_I).$$

Otherwise, control is passed to state S4 on path 318.

When state S4 is reached, one zone has been initialized so internal variables are updated to reflect this. A vector or array variable ZoneInitialize($Z_I$) is set true and the valve solenoid corresponding to $Z_I$ is closed. If all zones are initialized (i.e. ZoneInitialize is true for all $Z_I$), control passes to state S5 on path 328. Otherwise, if more zones need to be initialized, control passes on path 314 to state S1.

4. Adjust Mode

If the pressure in the zone falls to between 20 percent and 90 percent of the desired pressure or increases to above 130 percent of the desired pressure, the regulator acts to rapidly correct the pressure in the problem zone by entering an "adjust" mode. First, the regulator turns on the blower and drives it to produce an air pressure which substantially equals the air pressure in the zone to be corrected. The regulator does this by monitoring the air pressure at the output of the blower 154 through the fifth pressure sensor 170-5, and comparing the reading at that pressure sensor with the pressure sensor for the zone to be corrected. When the pressures are as equal as possible within the limits of blower operation, and if the pressure in the zone still differs from the desired pressure by more than ten percent, then the valve between the blower and the zone to be corrected is opened. Opening this valve should produce no net air flow between the blower and the pressure zone because the pressure at the blower outlet is the same as the pressure in the zone. The blower's operation rate is then slowly adjusted, either upward or downward, until it produces the desired pressure. If the pressure produced by the blower is higher than the pressure in the zone, then air flows from the blower into the bags of the zone to be corrected. If the air pressure produced by the blower is lower than the air pressure in the zone to be corrected, then air flows from the air bags into the blower and out the blower inlet. When the pressure at the blower outlet and the pressure in the zone both equal the desired pressure, the corresponding valve is closed and, unless another pressure zone requires adjustment, the blower is shut off.

Alternatively, the adjustments can be made by driving the blower to produce the desired pressure and then opening the valve between the blower and the zone to be corrected. However, this results in a quick rush of air between the blower and the air pressure zone as the pressure is equalized, causing a rapid change in the pressure in the air bag supporting the patient. At best, this is a minor irritant to the patient and at worst, it can cause anxiety and prevent the patient from sleeping. Nevertheless, the mode is preferred for gross adjustments, for example, when several zones are at pressures very different from their respective desired pressures. This can occur when there is a major leak in the system or when a user is first placed onto the mattress. In this mode one or more valves may be opened even before the blower reaches the desired pressure in order to speed the adjustments.

The adjust mode is represented by states S5 to S8 of FIG. 26B. In state S5, $Z_I$ represents the zone with the highest desired pressure outside the 90% to 130% window. In S5, the blower is set to the desired pressure of $Z_I$. All solenoids which are close to the blower and not okay are opened. The delay variable is set to 2. Normally, control is passed to states S5, S6, S7, and S8 (possibly looping between S6 and S7) and continues until all zones are in the window. When all zones return to the 90% to 130% window, control is passed to the steady-state mode starting at state S9 on path 330. Otherwise, control is passed on path 340 to state S6.

In state S6, the delay variable is decremented by one and all solenoids close to the blower and not OK are opened. When all zones return to the 90% to 110% window, control is passed to the steady-state mode starting at state S9 on path 338. If the delay variable is greater than zero, control remains in state S6 as shown by path 334. If delay equals zero, control is passed on path 342 to state S7.

In state S7, blower adjustments are made depending on the pressure variance of the zone, using the following pseudocode steps:

```
if    (ZoneActual < ZoneDesired + 5%) then
      if (Slightly Low) then Increment Blower 6;
      else (Very Low) then Increment Blower 12;
else  if (ZoneActual > ZoneDesired + 10%)
      then DecrementBlower (6)
      else Close Solenoid
Ensure Z_I Solenoid is Open
Set Delay = 0
```

Thus, if a very low zone is found, it is serviced promptly. Thereafter, if the zone is not OK, control passes to state S6 on path 336. When all zones return to the 90% to 110% window, control is passed to the steady-state mode starting at state S9 on path 330. If the zone $Z_I$ is OK, control passes to state S8 on path 344.

State S8 simply tests whether all the zones are OK. If all zones are in the 90% to 110% window, control is passed to the steady-state mode starting at state S9 on path 330. If not, control is passed to state S5 on path 332.

5. Steady-State Mode

In the normal mode (also referred to as the "steady-state" or "regular" mode), starting at state S9 of FIG. 26, the regulator monitors the pressure in each of the four air pressure zones and individually adjusts the air pressure to stay within 90% to 110% of a preselected patient profile.

The patient profile is determined by the weight and height of the patient. The profile is designed so that maximum mattress surface area contacts the patient at all times. Sufficient support must be provided for all patient weights between 40 and 300 pounds, and all heights between 48 and 78 inches. The regulator stores weight and height values so that when it is activated it sets the air pressure in each uniform pressure zone for the patient with which the controller was last used.

Initially, the patient's height and weight are entered using the keyboard. The keyboard (FIG. 22) includes a weight display 180 and a height display 182 which provide a numerical readout of the selected weight and height. Below each weight and height display are a pair of adjustment buttons. The weight can be adjusted upwards by pushing a weight up adjustment button 184 and adjusted down by pushing a weight down adjustment button 186. Similarly, the height can be adjusted up by pushing a height up adjust button 188 and adjusted down by pushing a height down adjust button 190.

Once the weight and height are set the regulator determines the appropriate air pressure for each uniform pressure zone. Zone pressures are preferably calculated using the following algorithm:

1. Determine initial pressure using Table 1. The data of Table 1 assumes a height of 72 inches and can be stored in a memory look-up table in conventional fashion.

2. Modify the initial pressure according to the patient's height as follows:

Zone 1: $Z1P = IZ1P + IZ1P \times ((0.5H - 0.5D)/100)$

Zone 2: $Z2P = IZ2P + IZ2P \times ((H - D)/100)$

Zone 1: $Z3P = IZ3P + IZ3P \times ((5D/6 - 5H/6)/100)$

Zone 1: $Z4P = IZ4P + IZ4P \times ((5D/6 - 5H/6)/100)$ where D=default height (72 inches), H=patient height, Z1P=Zone 1 Pressure and IZ1P=Initial Zone 1 Pressure.

TABLE 1

| Weight (lbs) | Pressure Profile by Patient Weight Zone 1 (mm Hg) | Zone 2 (mm Hg) | Zone 3 (mm Hg) | Zone 4 (mm Hg) |
|---|---|---|---|---|
| 40–109 | 8.0 | 12.1 | 12.1 | 3.0 |
| 110–119 | 8.0 | 12.1 | 12.1 | 3.2 |
| 120–129 | 8.0 | 12.1 | 13.5 | 3.4 |
| 130–139 | 8.0 | 12.1 | 13.5 | 3.6 |
| 140–149 | 8.0 | 12.1 | 13.5 | 3.8 |
| 150–159 | 8.0 | 12.1 | 13.5 | 4.0 |
| 160–169 | 8.0 | 13.6 | 15.0 | 4.2 |

TABLE 1 -continued

| Weight (lbs) | Pressure Profile by Patient Weight Zone 1 (mm Hg) | Zone 2 (mm Hg) | Zone 3 (mm Hg) | Zone 4 (mm Hg) |
|---|---|---|---|---|
| 170–179 | 8.0 | 13.6 | 15.0 | 4.4 |
| 180–189 | 8.0 | 13.6 | 15.0 | 4.6 |
| 190–199 | 8.0 | 13.6 | 15.0 | 4.8 |
| 200–209 | 8.0 | 13.6 | 15.0 | 5.0 |
| 210–219 | 8.0 | 13.6 | 16.4 | 5.3 |
| 220–229 | 8.0 | 15.0 | 17.9 | 5.6 |
| 230–239 | 8.0 | 15.0 | 19.3 | 5.8 |
| 240–300 | 8.0 | 15.0 | 19.3 | 6.0 |

Patient pressure profiles, currently used for low air flow mattresses, are equally applicable to the present invention. The zone pressures determined above should be sufficient for most patients with normal proportions. For unusual patients or patients who are particularly sensitive in one area, the operator can adjust the predetermined pressure in each of the four zones by plus or minus 20 percent, in five percent increments, using a set of zone pressure adjustment keys. There are four up adjustment keys 192, one for each zone, and a set of four down adjustment keys 194, one for each zone. An LED display 196 indicates the adjustment which has been made to the predetermined patient profile. Once the patient profile has been determined, it is stored in the form of an air pressure value for each zone in a memory in the regulator.

In the normal mode, the regulator monitors the pressure in each zone by reading the pressure sensor output for that zone, compares the measured pressure to the predetermined desired pressure for that zone and then, if the pressure in that zone differs from the desired pressure by greater than a threshold amount, the regulator drives the blower to adjust the pressure in that zone until it equals the desired pressure. As presently preferred, the regulator polls the reading in each of the zone pressure sensors every quarter second. The polled values are accumulated in groups of four. Each second the values are averaged and compared to the corresponding predetermined, desired pressure for that zone. Averaging the pressures over a period of a second prevents the regulator from responding to the patient's movements which can increase or decrease the pressure in a particular zone for a very brief period of time. As long as the pressure in the zones remains within plus or minus ten percent of the desired pressure for that zone, no adjustment to the pressure is done and the blower remains shut off. Since the bag's tubing and connectors are all designed to minimize air leakage as much as possible, most of the time that the mattress is in this mode, the blower is off and the mattress consumes very little energy and makes essentially no noise.

The steady-state mode can be implemented in states S9 to S13 of FIG. 26. A normally operating mattress will tend to cycle through states S9, S10, S11, and S13 before settling at S9 for long periods of time. Control remains in state S9 until actual pressure of one zone falls outside the window for at least 3 seconds. State S13 keeps control until the zone is adjusted to a 100% to 105% window (zones 2, 3) or a 95% to 100% window (zones 1, 4), after which state S9 gets control.

State S9 is reached on path 330 when all zones return to the 90% to 110% window. Zones falling outside the window are accumulated in a ZoneBadCount variable. In state S9 the following pseudocode steps are carried out:

```
Initialize all ZoneBadCounts to 3.
Z_I  = zone of highest priority that is not OK
if   not (90% Desired < ZoneActual < 110% Desired) then
     ZoneBadCount(Z_I) = ZoneBadCount(Z_I) - 1
if   (ZoneBadCount(Z_I) = 0) then
     Set Blower to zone Z_I's desired pressure;
     Close all solenoids;
     Set delay = 2;
     If ZoneActual < 15, then branch to state S7
```

If all zones are OK, i.e. ZoneBadCount>0, then control remains in state S9 as indicated by path 348. If the ZoneBadCount=6 (all zones) and any zone<15 mm Hg, then control is passed to state S7 on path 346. If ZoneBadCount=0 and all zones are greater than 15 mm Hg, then control is passed on path 350 to state S10.

In state S10, the delay variable is decremented by one (Delay=Delay−1). If the delay variable is greater than zero, control remains in state S10 as shown by path 352. As shown in block 353, if the mean pressure of one or two zones is above 130% of the desired pressure, and the current state is in the steady-state mode, control is passed to state S10. If the delay variable equals zero, control is passed to state S11 on path 356.

State S11 causes the solenoid corresponding to $Z_I$ to open if (ZoneMean($Z_I$)−10)<BlowerActual pressure<(ZoneMean($Z_I$)+10). Otherwise, state S11 increments or decrements the blower speed proportional to the difference between BlowerActual and ZoneMean($Z_I$). Three branch paths from state S11 are possible. First, control is passed to state S10 on path 358 if BlowerActual<ZoneMean($Z_I$)−10 or BlowerActual>ZoneMean($Z_I$)+20. Second, control is passed to state S13 on path 364 if BlowerActual=ZoneMean($Z_I$) +/−10. Third, control is passed to state S9 on path 362 if:

```
if   ((Z_I=1) or (Z_I=4)) then
     95% Desired < Actual <= 100% Desired
if   ((Z_I=2) or (Z_I=3)) then
     100% Desired <= Actual < 105% Desired.
```

This logic similarly forms exit paths 354, 376, and 372 for states S10, S13, and S12, respectively.

If none of the foregoing three tests is true, control remains in state S11 on path 360.

State S13 tests whether the solenoid corresponding to $Z_I$ is open, and if not, the solenoid is opened. Next, if (($Z_I$=1) or ($Z_I$=4) then the blower is adjusted until ZoneDesired−5%<ZoneActual<ZoneDesired. If (($Z_I$=2) or ($Z_I$=3) then the blower is adjusted until ZoneDesired <ZoneActual<ZoneDesired+5%. Control remains in state S13 on path 366 as long as pressure in zone $Z_I$ is not within 5% of the OK window. The only exit from state S13 is path 376 using the above logic.

State S12 is reached on path 374 when the mean pressure of any one zone is less than 75% of the desired pressure and the current state is any of states S9 to S13. Control remains in state S12 on path 370 as long as the delay variable is not zero. When the delay variable reaches zero, control is passed to state S13 on path 368.

6. Alarm Operation and Other Control Features

The foregoing logic is effective to monitor several high priority conditions.

First, if the mean pressure of any zone is less than 20% of desired and the current state is Initialize, Adjust, or Steady State, control is passed to MAX 3 to recover. This case can occur when multiple hoses are disconnected or when a patient leaves the mattress.

Second, if the mean pressure of two or more zones is less than 75% of desired and the current state is Steady State, control is passed to MAX 3 to recover. Third, if the mean pressure of one zone is less than 75% of desired, then all solenoids except the low one are closed, the blower is set to the desired pressure, and control is passed to state S12. These two cases can occur if there are one or more fairly large leaks, or when a patient sits up or shifts to a different position.

Fourth, if the mean pressure of 3 or 4 zones is greater than 130% of desired, control is passed to state SO of the initialize mode. This can occur when a patient lies down on a previously unloaded bed or if the bed is adjusted to a sitting position.

Fifth, if the mean pressure of 1 or 2 zones is greater than 130% of desired, control is passed to state S10. This can occur when a patient shifts position or the bed is adjusted to a sitting position.

Special processing is done for a leaky mattress. A normal mattress requires the blower to turn on about every 5 minutes; a leaky mattress may trigger the blower every minute. This can annoy the patient, making it desirable to leave the blower on. Therefore, the blower will be left on for a minimum of 3 extra minutes any time the zones are within the desired window, if the mattress is determined to be leaky according to the following:

$$\text{LeakScore}=(0.4\times TOFF0)+(0.3\times TOFF1)+(0.2\times TOFF2)+(0.1\times TOFF3)$$

where

TOFF0 is the amount of time the zones were most recently within the window; and

TOFF1, TOFF2, and TOFF3 are the amount of times the zones were second, third, and fourth most recently in the window, respectively.

Thus, LeakScore represents a weighted average of the last four times the mattress was in the window. If LeakScore is less than 180 (3 minutes), then the mattress is considered leaky and the blower will be left on.

The controller continues in normal mode until instructed otherwise. As explained above, the controller engages the CPR mode when it detects that the CPR valve is in the CPR position. It engages the max-inflate when the max-inflate button is pushed. In the normal mode, if the pressure in any one zone falls below 20 percent of the desired pressure, then the regulator switches operation to the max-inflate mode and sounds an alarm indicating a significant leak in the mattress system. The alarm system monitors several aspects of the mattress's operation and features both an audible alarm and a set of blinking LED's which indicate the general reason for the alarm. The audible portion of the alarm can be silenced by pushing an alarm silence button 198 on the keyboard. The blinking alarm cannot be silenced. A significant leak is indicated by a blinking SYSTEM FAILURE LED display 202. The regulator monitors how frequently a pressure adjustment must be made. If the pressure in any one zone falls to below 75 percent of the desired pressure more often than every ten minutes, the alarm also sounds, indicating a system failure. When the CPR mode is activated, a CPR RESET LED 204 blinks in conjunction with the audible alarm. Preferably, the regulator also monitors the voltage produced by the back-up batteries, and when the back-up battery voltage falls below an acceptable level for driving the controller, a BATTERY LED 206 flashes along with the audible alarm. The keyboard also features a lock out key 200 which shuts down all other keyboard buttons to minimize the likelihood that the settings will be tampered with.

In the event of any of the above failures and for regular maintenance, it is preferred that the regulator include a communications port hidden within the housing which allows it to be coupled to a portable computer. Preferably the communications port is a conventional RS232-type interface, although any other type of interface can be used if desired. The communications port preferably allows an operator to monitor the entire operation of the regulator, including reading all pressure sensor inputs and control outputs. In the event of a leaky air bag which has resulted in activation of the system failure alarm, the communications port allows the operator to quickly determine the pressure zone to which the leaky bag belongs and the severity of the problem. The results of any diagnostic subroutines can also be communicated to the microcomputer, and additional diagnostic subroutines can be performed by the microcomputer through the communications port on the regulator and the other system components.

Figure 23:
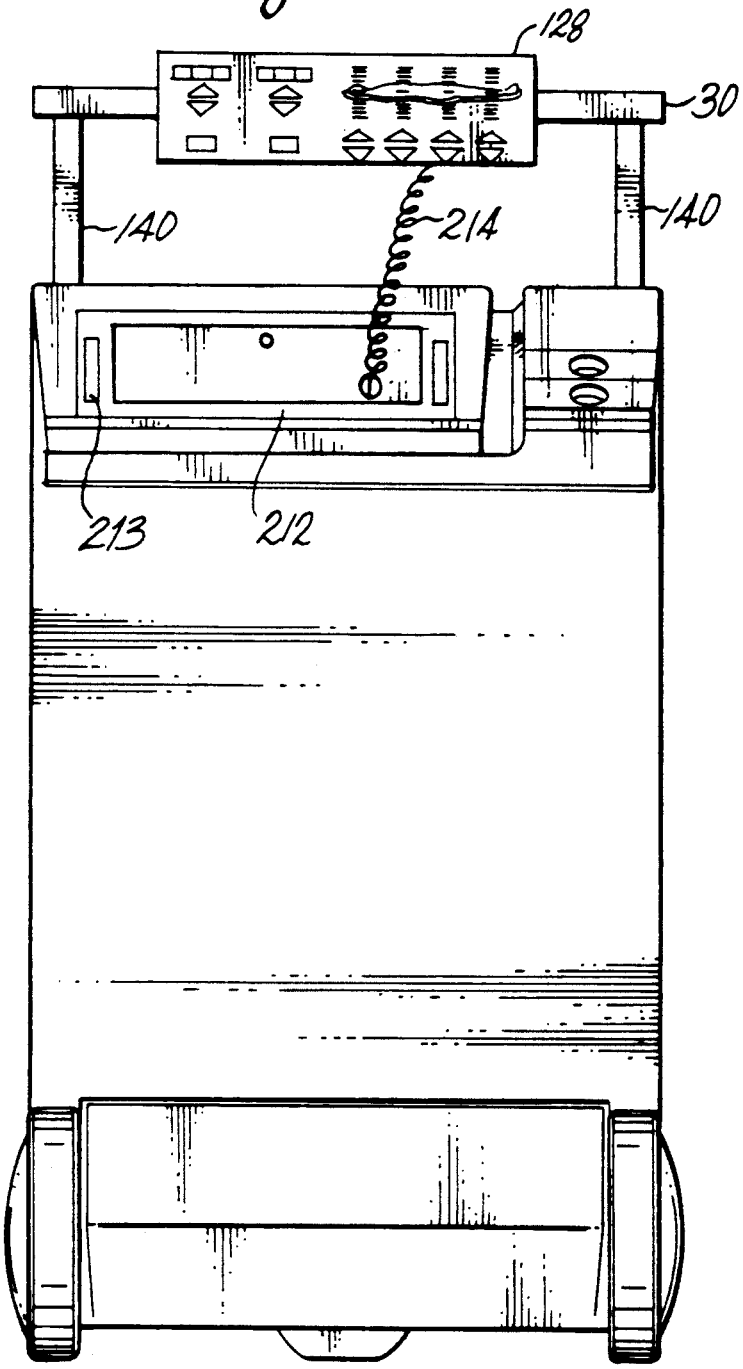
FIG. 23 is a front view of the controller of FIG. 17 with the keyboard removed from its controller housing and attached to the controller handle.
Figure 24:
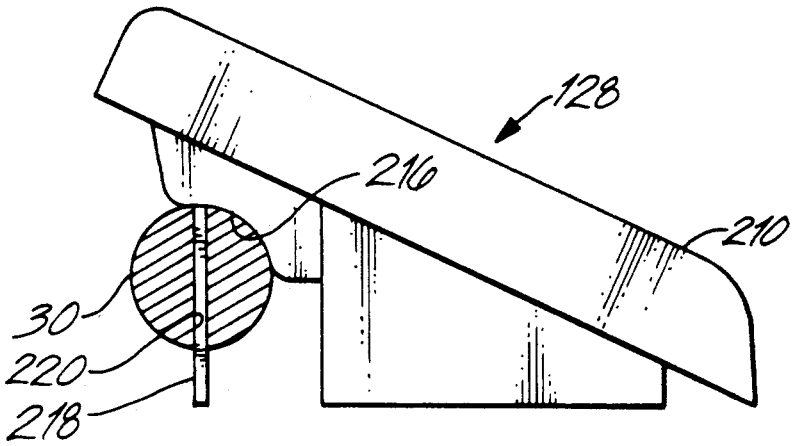
FIG. 24 is a side view of the keyboard of FIG. 21 installed on the controller handle.

The keyboard is preferably mounted to its own independent housing 210 (FIG. 24) which sets into a recess or holder 212 on the controller housing (FIG. 23). Magnetic strips 213 can be used to hold the keyboard in place. This allows the keyboard to be lifted up and out of the controller housing and moved to different locations for greater convenience. Electrical communication with the controller housing is maintained through a keyboard umbilical cord 214 which is stored in the controller housing when the keyboard is restored to its holder. The bottom side of the keyboard housing has a contour 216 which is designed to match the shape of the top bar of the handle 30 (FIG. 24). A pin 218 extends from the approximate center of this contour and fits into a bore 220 through the top bar of the handle. When the pin on the keyboard is hooked into the bore on the handle, the keyboard is held and retained by the pin on the top bar of the handle. The contour enhances the stability of the keyboard on the handle and prevents it from rotating about the pin. Since the handle is vertically adjustable using the handle adjustment lever 141, the position of the keyboard can be moved up or down to maximize the comfort of the operator and to make its display easier to read as the status of the mattress system is monitored by hospital staff. When the controller is to be moved, the keyboard can be easily lifted up off of the handle and replaced in its recess on the controller.

Figure 25:
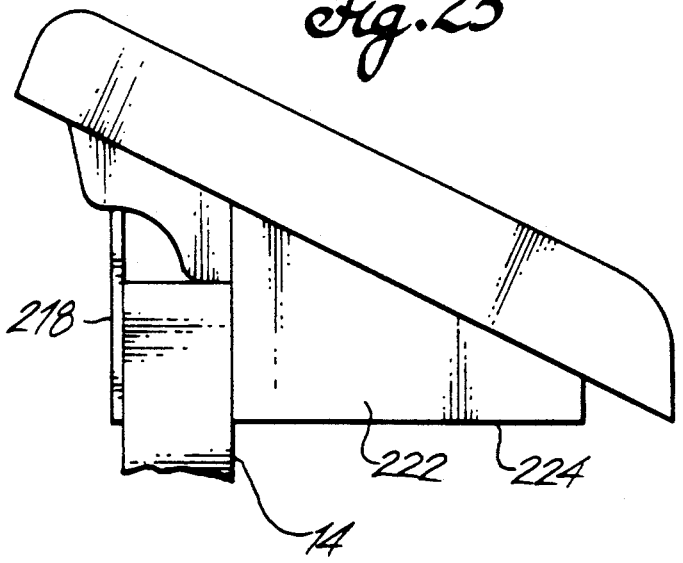
FIG. 25 is a side view of the keyboard of FIG. 21 installed on a bed frame footboard.

The keyboard housing can also be hung from a bed footboard. The keyboard housing includes a pair of bottom stays 222 (only one of which is shown in FIG. 25) which extend parallel to and spaced apart from the pin 218. The keyboard is hooked onto the footboard 14 or headboard 16 of a bed by bracketing the footboard between the pin and the stays. The distance between the pin and the stays is chosen to correspond approximately to the width of the most common footboards in hospital use. These stays also have a horizontal surface 224 which allows the keyboard to be placed on a flat surface and still be supported in a convenient angled position. The length of the pin matches the level of the horizontal surface so that the base of the keyboard is supported by the pin 218 as well as the horizontal surfaces 224.

While the present invention has been described in the context of a particular embodiment, a great variety of adaptations and modifications can be made. The invention may be used outside of a hospital anywhere that an extremely comfortable, adjustable bed is desired. The invention has been described as an air mattress; however, it is not necessary that air be used. Any variety of fluids, the pressure or volume of which can be adjusted, may be used with appropriate adjustments to the materials involved. Water and any of the inert gases are examples. The air can also be enriched with moisture or some type of medication to further reduce the likelihood that the air will become infected. The air temperature can also be regulated in a variety of ways. A conventional low air-loss mattress typically incorporates a heater in the air supply in order to keep the patient warm. Because of the virtual lack of air flow in the present invention, this is presently considered unnecessary, however, heating could be provided, for example, in the air supply or adjacent the air bags below the user.

A great variety of other modifications and adaptations are possible without departing from the spirit and scope of the present invention. It is not intended to abandon any of the scope of the claims below by describing only the embodiment above. Thus, the scope of the invention should be determined from the appended claims, in which:

What is claimed is:

1. A mattress comprising:

a plurality of bags for supporting a user by containing fluid under pressure, each bag being associated with one of a plurality of separate mattress fluid pressure zones.

a variable speed blower operable for supplying fluid to the bags at an adjustable pressure related to the operational rate of the blower, a separate duct connectible between each mattress pressure zone and an outlet from the blower via a respective one of a corresponding plurality of bistable fluid flow control ON/OFF valves, the communication of each bag to the blower outlet otherwise being an unvalved communication, a corresponding plurality of fluid pressure sensors proximate the blower for measuring the fluid pressure in a respective one of the mattress pressure zones, a pressure supply passage connectable from each mattress zone to the corresponding pressure sensor, and a blower regulator receiving output signals from the pressure sensors for controlling the operational rate of the blower and for operating the valves to establish and to maintain in the bags in each mattress zone a fluid pressure selected for that zone.

2. A mattress according to claim 1 wherein the bags are made of a fluid impermeable material for substantially no flow of fluid through the bags, and the regulator operates to adjust mattress zone pressure on a demand basis.

3. A mattress according to claim 1 wherein the blower, the valves, the pressure sensors and the regulator are components of a mattress controller which is physically independent of the mattress and of a bed on which the mattress may be located.

4. The mattress of claim 3 wherein, the controller comprises:

a keyboard for inputing instructions to the controller; and a holder for receiving and holding the keyboard.

5. The mattress of claim 4 wherein the controller includes a housing and a handle which is adjustable to different vertical positions and also is adapted to receive and hold the keyboard.

6. The mattress of claim 4 wherein the controller is adapted to engage the footboard of a bed frame so that it can be received and held by a bed frame footboard.

7. The mattress of claim 1 wherein the regulator is operable for adjusting the pressure supplied by the blower to substantially equal the pressure in a particular zone before opening a valve for allowing fluid flow between the blower and the particular zone.

8. The mattress of claim 1 comprising means for reversing the direction of flow in the ducts from the bags to the blower to deflate the bags.

9. The mattress of claim 5 wherein the blower comprises a low pressure inlet and a high pressure outlet, the bags being connected through the ducts to the outlet for inflation, and wherein the reversing means comprises a reversing valve operable for connecting the ducts to the blower low pressure inlet.

10. The mattress of claim 1 comprising means for serially comparing each measured pressure with a predetermined desired pressure, and wherein the regulator is operable for independently opening and closing each of the valves to adjust the pressure in each zone, one zone at a time, for each zone for which the difference between the measured pressure and the desired pressure differs by more than a threshold amount.

11. The mattress of claim 10 further comprising means for adjusting the blower operation to supply fluid at a pressure corresponding to the measured pressure for a particular zone before opening the valve corresponding to that zone.

12. The mattress of claim 1 wherein the bags each have a bead on one edge and wherein the mattress comprises a mattress base for supporting the bags and a plurality of bag attachment fittings for attaching the bags to the mattress base, each bag attachment fitting comprising means for receiving and holding captive substantially along its length a bag edge bead.

13. The mattress of claim 12 wherein the mattress base comprises a foam pad substrate.

14. The mattress of claim 1 comprising a tab for securing the mattress to a variety of different bed frames, the tab comprising:

a hand malleable plate bendable into a shape sufficient to grasp an edge of a bed frame; and a hinge for fastening the plate to the mattress.

15. In a mattress having a plurality of bags for supporting a user, the bags being supported on a base, a bag attachment fitting for connecting the bags to the base comprising:

an elongated sleeve carried by the base and having an interior chamber with a substantially uniform cross section for receiving a bead on a bag;

an elongated narrow slit extending along the sleeve into the chamber for allowing a bag bead carrier to extend into the chamber;

an opening for allowing the bead to be inserted into the chamber.

16. A mattress according to claim 15 wherein the opening is in the slit.

17. In a mattress having a plurality of bags connectable to a base for supporting a user a method for connecting a bag to the base comprising:

inserting an end of an elongated bead of the bag into an opening in an elongated sleeve in the base;

moving a portion of the bag adjacent the bead into an elongated slit in the sleeve adjacent the opening and alongside the sleeve; and drawing the bead of the bag into the sleeve by pulling the portion of the bag adjacent the bead along the elongated slit.

18. The method of claim 17 further comprising drawing the bead into the sleeve until the end of the bead abuts an end cap at an end of the sleeve.

19. In a mattress having a plurality of bags connectable to a base for supporting a user, the bags having elongated beads inserted into corresponding elongated sleeves in the base for holding the bags to the base, a method for removing a bag from the base comprising:

moving an end of the bead of the bag into an opening in the elongated sleeve by pulling upon a portion of the bag adjacent the bead which extends through an elongated narrow slit in the sleeve; and drawing the bead out of the sleeve through the opening.

20. A mattress comprising:

an elongate base having a cushion;

a plurality of bags connected to and supported by the base for supporting a user by containing fluid under pressure, the bags being deflatable to allow the user to be supported on the cushion; and a plurality of elongate bag attachment fittings, each fitting being carried by and substantially imbedded into the cushion to minimize the pressure of the fittings against the user when the bags are deflated.

21. A mattress according to claim 20 wherein the base has length and width dimensions related to the corresponding dimensions of a mattress with which the base is useable, and wherein the bag attachment fittings extend substantially perpendicular to the length of the base and substantially parallel to each other.

22. A method for maintaining desired fluid pressures in each of a plurality of pressure zones in a mattress which includes a plurality of bags for supporting a mattress user by containing fluid under pressure, individual ones of the bags being grouped in the mattress in respective ones of the zones, the method comprising the steps of connecting the bag group in each zone to the output of a variable speed blower via a separate duct and via a respective one of a corresponding plurality of bistable ON/OFF flow control valves proximate the blower, measuring proximate the blower the pressure in each zone via a respective one of a corresponding plurality of fluid pressure sensors each coupled via a separate pressure supply passage to the corresponding mattress zone, comparing each measured pressure to a predetermined pressure to be maintained in the corresponding zone, and in the event a comparison indicates that the measured pressure differs from the predetermined pressure by more than a chosen amount, performing the following steps in sequence:

operating the blower to generate a fluid pressure substantially equal to the measured pressure, opening the valve to the zone having that measured pressure, and controllably changing the speed of blower operation to a speed productive of the predetermined pressure.

23. A method according to claim 23 further including coupling each bag in a mattress zone to a respective manifold chamber in a bag support base connectable to a bed frame, and connecting the ducts and the passages to the respective manifold chambers.

24. A method according to claim 23 including locating the blower, the valves and the pressure sensors in a controller physically separate from the mattress and from a bed on which the mattress may be placed.

25. A method according to claim 23 including the further steps of obtaining a set of initial predetermined pressure values for the several zones from a memory unit in terms of the height and weight of the mattress user, and modifying the initial values, if and as appropriate, to define operating predetermined pressure values for the particular mattress user.

26. A method according to claim 23 including the further steps of averaging a selected number of pressure measurements made over a selected time interval, and comparing the averaged measured pressure to the corresponding predetermined pressure.

27. A method according to claim 22 further comprising initially establishing the predetermined pressures in the respective mattress zones by a procedure comprising the steps of operating the blower at a maximum rate with all valves open, closing the valves, and thereafter, for each of the zones in a selected sequence, performing the measuring, comparing, operating, opening and controllably changing steps described in claim 22.

* * * * *

UNITED STATES PATENT AND TRADEMARK OFFICE

CERTIFICATE OF CORRECTION

PATENT NO. : 5,235,713

DATED : August 17, 1993

INVENTOR(S) : Brian Guthrie; Keith Gilroy; Henry Canino

It is certified that error appears in the above-indentified patent and that said Letters Patent is hereby corrected as shown below:

Column 8, line 29, change "fitting, 34" to -- fitting 34, --.
Column 14, line 18, change "265" to -- 266 --.

Column 22, line 35, after "zones" change the period to a comma.
Column 23, line 19, change "claim 5" to -- claim 8 --.
Column 25, line 1, change "claim 23" to -- claim 22 --.
Column 25, line 6, change "claim 23" to -- claim 22 --.
Column 25, line 11, change "claim 23" to -- claim 22 --.
Column 26, line 3, change "claim 23" to -- claim 22 --.

Signed and Sealed this

Tenth Day of May, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,235,713

DATED : August 17, 1993

INVENTOR(S) : Brian Guthrie, Keith, Gilroy, Henry Canino

It is certified that error appears in the above-indentified patent and that said Letters Patent is hereby corrected as shown below:

In the Title Page:

immediately above the International and U.S. classification data, insert as follows:

[30] Foreign Application Priority Data
Nov. 6, 1990 PCT/US90/06446

Signed and Sealed this

Eighth Day of November, 1994

*Attest:*

Bruce Lehman

BRUCE LEHMAN

*Attesting Officer*

*Commissioner of Patents and Trademarks*